US012692698B2

(12) United States Patent
Sudo et al.

(10) Patent No.: US 12,692,698 B2
(45) Date of Patent: Jul. 28, 2026

(54) WOODEN LOAD-BEARING WALL, METHOD OF CONSTRUCTING WOODEN LOAD-BEARING WALL, METHOD OF INCREASING CO-EFFICIENT OF EFFECTIVE WALL LENGTH OF WOODEN LOAD-BEARING WALL, AND GYPSUM-BASED LOAD-BEARING BOARD

(71) Applicant: YOSHINO GYPSUM CO., LTD., Tokyo (JP)

(72) Inventors: Ushio Sudo, Tokyo (JP); Katsumi Niimi, Tokyo (JP); Tomoya Hasegawa, Tokyo (JP); Takuji Yamashita, Tokyo (JP); Kozo Akai, Tokyo (JP); Yousuke Sato, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 161 days.

(21) Appl. No.: 18/692,972

(22) PCT Filed: Sep. 22, 2022

(86) PCT No.: PCT/JP2022/035489
§ 371 (c)(1),
(2) Date: Mar. 18, 2024

(87) PCT Pub. No.: WO2023/058470
PCT Pub. Date: Apr. 13, 2023

(65) Prior Publication Data

US 2024/0392562 A1 Nov. 28, 2024

(30) Foreign Application Priority Data

Oct. 5, 2021 (JP) ..... 2021-163783

(51) Int. Cl.
*E04B 2/70* (2006.01)
*E04B 2/00* (2006.01)
*E04C 2/04* (2006.01)

(52) U.S. Cl.
CPC ..... *E04B 2/707* (2013.01); *E04C 2/043* (2013.01); *E04C 2/46* (2013.01); *E04B 2103/02* (2013.01)

(58) Field of Classification Search
CPC ..... E04B 2/707; E04B 2103/02; E04B 2001/2696; E04B 1/98; E04B 2/56;
(Continued)

(56) References Cited

U.S. PATENT DOCUMENTS 3,903,879 A * 9/1975 Riley ..... A61L 15/08 602/8
10,377,108 B2 * 8/2019 Chan ..... C04B 28/14
(Continued)

FOREIGN PATENT DOCUMENTS

AU 2017219210 B2 * 1/2021 ..... C04B 24/32
JP H09-217476 8/1997
(Continued)

OTHER PUBLICATIONS

Allowable Stress Design for Wooden Framework Construction Method Housing [1] (2017 edition), pp. 63 and 300 to 301 with partial English translation.
(Continued)

*Primary Examiner* — Omar F Hijaz
(74) *Attorney, Agent, or Firm* — IPUSA, PLLC

(57) ABSTRACT

A wooden load-bearing wall having a structure in which a gypsum-based load-bearing board is fastened to a wooden wall base, is provided. The gypsum-based load-bearing board includes a main material formed from a board-shaped hardened gypsum; and a paper covering at least front and
(Continued)

back surfaces of the main material. The gypsum-based load-bearing board has a surface density in a range from 6.5 $kg/m^2$ to 8.9 $kg/m^2$; a lateral nail resistance of 500 N or more; and a compressive strength of 6.5 $N/mm^2$ or more. The main material contains an inorganic fiber and an organic-based strength enhancer. The gypsum-based load-bearing board has a correction value (Pu') of an ultimate strength (Pu) of 7.7 kN or more, measured by an in-plane shear test.

23 Claims, 6 Drawing Sheets

(58) Field of Classification Search
CPC ... E04C 2/043; E04C 2/46; E04C 2/04; E04C 2/26; B32B 13/02; B32B 13/04; B32B 13/14; B32B 13/08; E04H 9/021
See application file for complete search history.

(56) References Cited

U.S. PATENT DOCUMENTS

2004/0092625 A1* 5/2004 Pollock ..... C04B 24/383 156/39
2006/0240236 A1* 10/2006 Bland ..... E04C 2/043 428/292.1
2015/0010730 A1* 1/2015 Faynot ..... B32B 13/14 428/141
2018/0093448 A1* 4/2018 Marskell ..... B28B 23/0006
2023/0416153 A1* 12/2023 Iyer ..... B32B 5/18
2024/0157676 A1* 5/2024 Fisher ..... E04C 2/043

FOREIGN PATENT DOCUMENTS

JP H09-302802 11/1997
JP H10-302802 11/1998
JP 2002-070239 3/2002
JP 2009-299460 12/2009
JP 2015-165087 9/2015
JP 2021-080142 5/2021
WO 2019/203148 10/2019
WO WO-2019203148 A1 * 10/2019 ..... E04B 2/56
WO 2021/205993 10/2021

OTHER PUBLICATIONS

International Search Report for PCT/JP2022/035489 mailed on Nov. 22, 2022.
Written Opinion of the International Searching Authority for PCT/JP2022/035489 mailed on Nov. 22, 2022.
Office Action mailed on Jun. 17, 2026 with respect to the corresponding Indian patent application No. 202417020270.

* cited by examiner

FIG.1

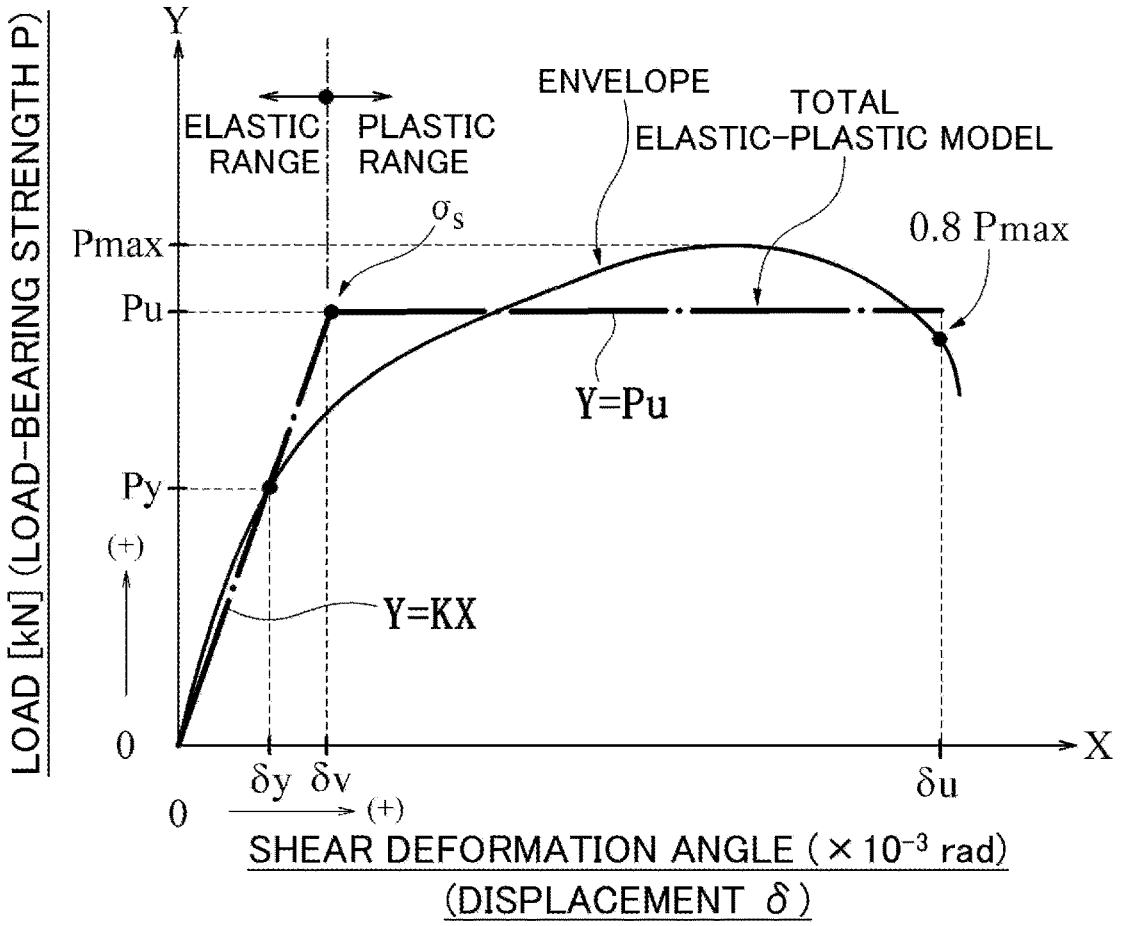

$\delta u$ : ULTIMATE DISPLACEMENT $\delta v$ : YIELD POINT DISPLACEMENT ($\times 10^{-3}$ rad)

$\delta y$ : YIELD DISPLACEMENT ($\times 10^{-3}$ rad)

$\sigma_s$ : YIELD POINT

K : INITIAL STIFFNESS $\mu$ : PLASTICITY

Pmax : MAXIMUM LOAD-BEARING STRENGTH $P_u$ : ULTIMATE STRENGTH $P_y$ : YIELD STRENGTH $P_0 = \beta \times P_y$ ← STRUCTURAL GYPSUM BOARD $P_0 = \beta \times P_u'$ ← LOW-DENSITY GYPSUM-BASED LOAD-BEARING BOARD $$P_u' = P_u \times 0.2\sqrt{2\mu - 1}$$

$$\mu = \frac{\delta u}{\delta v}$$

$$P_a = P_0 \times \alpha$$

$$\text{CO-EFFICIENT OF EFFECTIVE WALL LENGTH} = \frac{P_a}{L \times 1.96\,(\text{kN/m})}$$

$P_a$ : SHORT-TERM ALLOWABLE SHEAR STRENGTH $P_0$ : SHORT-TERM REFERENCE SHEAR STRENGTH $P_u'$ : ULTIMATE STRENGTH (CORRECTION VALUE)

$\alpha$ : REDUCTION COEFFICIENT $\beta$ : VARIATION COEFFICIENT

L : LENGTH OF TEST PIECE (TEST WALL) (m)

FIG.4

| | | EXAMPLE | | | | COMPARATIVE EXAMPLE |
|---|---|---|---|---|---|---|
| | | ① | ② | ③ | ④ | |
| PHYSICAL PROPERTY | SURFACE DENSITY ($kg/m^2$) | 7.45 | 7.61 | 8.65 | 8.31 | 7.80 |
| | SPECIFIC GRAVITY | 0.77 | 0.78 | 0.89 | 0.81 | 0.80 |
| | THICKNESS (mm) | 9.68 | 9.76 | 9.72 | 9.75 | 9.75 |
| | COMPRESSIVE STRENGTH ($N/mm^2$) | 8.4 | 11.1 | 9.4 | 6.5 | 6.0 |
| | LATERAL NAIL RESISTANCE (N) | 516 | 765 | 664 | 640 | 600 |
| COMPOSITION | ORGANIC-BASED STRENGTH ENHANCER (PARTS BY WEIGHT BASED ON CALCINED GYPSUM) | 5.5 | 5.5 | 5.0 | 8.0 | 4.0 |
| | INORGANIC FIBER (PARTS BY WEIGHT BASED ON CALCINED GYPSUM) | 3.0 | 3.5 | 3.0 | 3.5 | 3.5 |
| RESULT OF LOAD-BEARING TEST | INITIAL STIFFNESS K ($kN/10^{-3}rad$) | 2.43 | 2.49 | 2.91 | 2.04 | 1.94 |
| | YIELD POINT DISPLACEMENT $\delta v$ ($\times 10^{-3}rad$) | 6.04 | 6.31 | 6.49 | 6.80 | 7.26 |
| | ULTIMATE DISPLACEMENT $\delta u$ ($\times 10^{-3}rad$) | 34.98 | 34.90 | 28.09 | 29.82 | 30.10 |
| | PLASTICITY $\mu$ ($\delta u / \delta v$) | 5.78 | 5.53 | 4.32 | 4.39 | 4.15 |
| | ULTIMATE STRENGTH (CORRECTION VALUE) Pu' (kN) | 9.60 | 11.90 | 10.40 | 7.80 | 7.62 |
| | SHORT-TERM ALLOWABLE SHEAR STRENGTH Pa (kN) | 7.20 | 8.92 | 7.80 | 5.85 | 5.72 |
| CO-EFFICIENT OF EFFECTIVE WALL LENGTH* | | 2.02 | 2.50 | 2.19 | 1.64 | 1.60 |

* ASSUME REDUCTION COEFFICIENT $\alpha$ = 0.75 AND VARIATION COEFFICIENT $\beta$ = 1.0.

SHORT-TERM REFERENCE SHEAR STRENGTH $P_0 = \beta \times P_u'$

SHORT-TERM ALLOWABLE SHEAR STRENGTH $P_a = P_0 \times \alpha$

CO-EFFICIENT OF EFFECTIVE WALL LENGTH $= \dfrac{P_a}{L \times 1.96\,(kN/m)} = \dfrac{P_a}{1.82m \times 1.96\,(kN/m)} = \dfrac{P_u'}{4.75\,(kN)}$

WOODEN LOAD-BEARING WALL, METHOD OF CONSTRUCTING WOODEN LOAD-BEARING WALL, METHOD OF INCREASING CO-EFFICIENT OF EFFECTIVE WALL LENGTH OF WOODEN LOAD-BEARING WALL, AND GYPSUM-BASED LOAD-BEARING BOARD

TECHNICAL FIELD

The present disclosure relates to a wooden load-bearing wall, a method of constructing the wooden load-bearing wall, a method of increasing co-efficient of effective wall length ("Kabe-bairitsu") of the wooden load-bearing wall, and a gypsum-based load-bearing board. More specifically, the present disclosure relates to a wooden load-bearing wall, a method of constructing the wooden load-bearing wall, a method of increasing co-efficient of effective wall length of the wooden load-bearing wall, and a gypsum-based load-bearing board that are configured to increase the co-efficient of effective wall length without relying on: an increase in the maximum load-bearing strength of the board itself; an increase in ultimate displacement; providing additional reinforcement materials or stiffening materials.

BACKGROUND OF THE INVENTION

Typically, methods of constructing wooden buildings are roughly divided into a wooden framework construction method and a wooden framework wall construction method. Due to the effects of recent large-scale earthquakes, research on the seismic resistance of wooden buildings has attracted much attention in recent years in our country (Japan). As described in Patent Document 1 (International Patent Publication No. WO 2019/203148 A1), in the practice of architectural design in our country (Japan), as an index of the strength of wooden buildings to resist short-term horizontal loads (seismic force, wind pressure, and the like), the framework length of load-bearing walls (the length of walls in a building plan) effective for structural load-bearing strength is typically used. For the calculation of the framework length, the co-efficient of effective wall length ("Kabe-bairitsu") corresponding to the structure of the load-bearing wall is used. The co-efficient of effective wall length is an index of the seismic resistance or the load-bearing strength of the load-bearing wall, and the larger the value, the greater the seismic strength. A wall structure with a large value of the co-efficient of effective wall length is advantageous in improving the design freedom and the seismic resistance of the entire building.

The co-efficient of effective wall length of general-purpose wooden load-bearing walls that have been used in our country (Japan) for a long time is stipulated in Article 46 of the Building Standard Law Enforcement Order, in Notification No. 1100 of the Ministry of Construction (Jun. 1, 1981), and in Notification No. 1541 of the Ministry of Land, Infrastructure, Transport and Tourism (Oct. 15, 2001). On the other hand, for a number of load-bearing walls in recent years that do not belong to such general-purpose wall structures, it is necessary to determine the co-efficient of effective wall length based on the approval of the Minister of Land, Infrastructure, Transport and Tourism as specified in Table 1 (viii) of Paragraph 4 of the same Article. For this reason, it is necessary to set the co-efficient of effective wall length of a relatively large number of recently constructed wooden load-bearing walls based on the performance tests conducted by designated performance evaluation agencies, and the test methods for these performance tests are described in detail in "Performance Test and Evaluation Methodology for Wooden load-bearing walls and Their Co-efficient of effective wall length" published by the respective testing and inspection agencies.

As described in a number of references, such as "Performance Test and Evaluation Methodology for Wooden load-bearing walls and Their Co-efficient of effective wall length", the performance test for determining the co-efficient of effective wall length of wooden load-bearing walls is an in-plane shear test of the load-bearing walls. In this test, a predetermined horizontal load is repeatedly applied to the test piece of the load-bearing wall, and the relationship between the horizontal load and the shear deformation angle is determined.

FIG. 1 is a diagram illustrating a load-deformation angle curve obtained by the in-plane shear test, as an envelope (indicated by a solid line). FIG. 1 illustrates a linear graph, indicated by a dash-dot line, in which the envelope of the load-deformation angle curve is converted to load-deformation angle characteristics of a total elastic-plastic model. The total elastic-plastic model consists of a linear function straight line (Y=KX) in the linear elastic range indicating the initial stiffness K, and a straight line (Y=Pu) in the plastic deformation region (plastic region) extending parallel to the X-axis from the yield point σs. The yield point σs indicates the elastic limit. The initial stiffness K is a coefficient that indicates the slope of the linear function straight line (Y=KX) in the elastic range. The area on the diagram of the region surrounded by line segments of the envelope, the X-axis, and X=δu is equal to the area on the diagram of the region surrounded by line segments of the X-axis, Y=KX, Y=Pu, and X=δu. The method of converting the envelope to the total elastic-plastic model is described in a number of references, such as "Performance Test and Evaluation Methodology for Wooden load-bearing walls and Their Co-efficient of effective wall length", and it is well known in material mechanics, so its further explanation is omitted.

FIG. 1 illustrates a maximum load-bearing strength Pmax, a 0.8 Pmax post-peak region, an ultimate strength Pu, a yield strength Py, an ultimate displacement δu, a yield point displacement δv, and a yield displacement δy. The ultimate displacement δu and the yield point displacement δv are the values of the deformation angle at the 0.8 Pmax post-peak region and at the yield point σs, respectively. The yield displacement δy is the value of the deformation angle at the onset of the yield strength Py. The plasticity μ is the value of the ultimate displacement δu/the yield point displacement δv.

The co-efficient of effective wall length is the value obtained by calculating the short-term allowable shear strength (Pa) based on the load-bearing strengths Pmax, Pu, Py, and the displacements δu, δv, and δy specified by the total elastic-plastic model illustrated in FIG. 1, and dividing the short-term allowable shear strength (Pa) by a predetermined load-bearing strength (wall length L(m)×1.96 (kN/m)), as described in a number of technical documents such as "Allowable Stress Design for Wooden Framework Construction Method Housing [1] (2017 edition)", pages 63 and 300 (Non-Patent Document 1). That is, the co-efficient of effective wall length is the indexed value obtained by dividing the short-term allowable shear strength (Pa) by the reference value (1.96L).

To further explain this point, in the calculation of the co-efficient of effective wall length, in principle, the load-bearing strength having the smallest value among the following four types of load-bearing strength values is specified as a short-term reference shear strength (P0), and the short-term reference shear strength (P0) is multiplied by a predetermined reduction coefficient (α) (a coefficient for evaluating the factor of the reduction in the load-bearing strength). Typically, in a case of gypsum-based load-bearing boards, the load-bearing strength illustrated in (1) or (2) below, that is, the yield strength (Py) or the ultimate strength (a correction value) (Pu'), has the smallest value. The following values of the load-bearing strength (Py, Pu, and Pmax) are obtained by multiplying each of the measured values by a variation coefficient (β).

(1) Yield strength (Py)

(2) Value of ultimate strength (Pu) corrected based on plasticity (μ) (hereinafter referred to as "ultimate strength (correction value) (Pu')")

(3) Value of ⅔ of maximum load-bearing strength (Pmax)

(4) Load-bearing strength when shear deformation angle=1/120 rad (for non-loading type or loading type)

A "structural gypsum board" is known as a gypsum-based board which can be suitably used as a load-bearing board for wooden load-bearing walls. The "structural gypsum board" is a gypsum-based board in which the lateral nail resistance of a "reinforced gypsum board" is enhanced based on the applicant's technique described in Japanese Patent No. 5642948 (Patent Document 2). The lateral nail resistance is the shear resistance or the shear strength of the nailed portion of the board measured by the lateral nail resistance test specified in JIS A 6901. Because the lateral nail resistance is described in relative detail in the applicant's application PCT/JP2021/14227 (Patent Document 3), further detailed explanation will be omitted. The lateral nail resistance is a physical property proposed by the applicant in Patent Document 2 as an element for determining the load-bearing strength of the gypsum-based load-bearing board, and it is a factor of load-bearing strength that the applicant has paid particular attention to in recent years.

The structural gypsum board is a gypsum-based board which has an overall improved load-bearing strength as a load-bearing board compared with (regular) gypsum boards, and has an improved lateral nail resistance compared with reinforced gypsum boards. The structural gypsum board is currently specified in JIS A 6901 as a gypsum-based board having a lateral nail resistance of 750 N or more (class A) or 500 N or more (class B). A wooden load-bearing wall that uses the structural gypsum board as the load-bearing board exhibits relatively higher co-efficient of effective wall length than a wooden load-bearing wall that uses a (regular) gypsum board or a reinforced gypsum board as the load-bearing board. The structural gypsum board, like the reinforced gypsum board, requires a thickness of 12.5 mm or more and a specific gravity of 0.75 or more. For this reason, the wooden load-bearing wall to which the structural gypsum board is fixed requires a surface density or a surface weight (the mass of the load-bearing board per unit area of the wall) of at least approximately 9.4 kg/m$^2$.

Typically, the short-term reference shear strength (P0) of a load-bearing wall in which the structural gypsum board is fastened to a wooden wall base by a fastener is specified by the yield strength (Py) among the above four types of load-bearing strength values (P0=β×Py). The co-efficient of effective wall length is the value in which the short-term reference shear strength (P0) is multiplied by the reduction coefficient (α) and divided by the predetermined load-bearing strength (1.96L), as described above. Therefore, the co-efficient of effective wall length of the load-bearing wall in which the structural gypsum board is fastened to the wooden wall base by the fastener is proportional to the yield strength (Py).

Patent Document 3 describes a gypsum-based load-bearing board that gives a short-term reference shear strength (P0) equal to that of the structural gypsum board to the load-bearing wall, but has a reduced surface density compared with that of the structural gypsum board. The gypsum-based board described in Patent Document 3 includes a main material or a core material formed from a board-shaped hardened gypsum containing an inorganic fiber and an organic-based strength-enhancer so as to exhibit a lateral nail resistance of 500 N or more, and a paper covering at least front and back surfaces of the main material or the core material, and has a surface density or a surface weight (hereinafter referred to as "surface density") within the range from 6.5 to 8.9 kg/m$^2$. The gypsum-based board described in Patent Document 3 can give a relatively high co-efficient of effective wall length to the load-bearing wall even when the board thickness is less than 12 mm. This gypsum-based board is a load-bearing board (hereinafter referred to as "low-density gypsum-based load-bearing board") developed with the objective of reducing the surface density and reducing the weight of the board, while limiting the reduction of the yield strength by a relatively high lateral nail resistance, compared with a conventional gypsum-based load-bearing board such as the structural gypsum board and the like, and is highly advantageous in practical use from the viewpoint of balancing the desired load-bearing strength as a wooden load-bearing wall with its light weight, workability, and the like.

Typically, in the short-term reference shear strength (P0) of a load-bearing wall in which the low-density gypsum-based load-bearing board is fastened to a wooden wall base by a fastener, the ultimate strength (correction value) (Pu') among the above four types of load-bearing strength values has the smallest value. Therefore, the short-term reference shear strength (P0) for calculating the co-efficient of effective wall length and the co-efficient of effective wall length are proportional to the ultimate strength (correction value) (Pu'), unlike the structural gypsum board. As described in Patent Document 3, in the low-density gypsum-based load-bearing board, as an unexpected effect, the toughness and the deformation followability potentially possessed by the gypsum-based load-bearing board become apparent due to the decrease in surface density, and as a result, the ultimate displacement (δu) of the load-bearing wall increases to obtain the ultimate displacement (δu) larger than $20\times10^{-3}$ rad. Accordingly, the load-bearing wall in which the low-density gypsum-based load-bearing board is fixed to the wooden wall base in Patent Document 3 exhibits the ultimate strength (correction value) (Pu') larger than 7.6 kN. Thus, as described above, the low-density gypsum-based load-bearing board exhibits the same load-bearing strength as the structural gypsum board while reducing the surface density as compared to the structural gypsum board.

The ultimate strength (correction value) (Pu') is a value obtained from the following equation based on the ultimate strength (Pu) and the plasticity (μ), and the short-term reference shear resistance (P0) is a value obtained from the following equation based on the ultimate strength (correction value) (Pu') and the variation coefficient (β) of the measured value.

$$Pu' = Pu \times 0.2 \times (2\mu - 1)^{1/2}$$

$$P0 = \beta \times Pu'$$

In order to further increase the short-term reference shear strength (P0) of the load-bearing wall using the low-density gypsum-based load-bearing board and to further increase the co-efficient of effective wall length, as is clear from the above equation, it is necessary to further increase the ultimate strength (correction value) (Pu') of the load-bearing wall, and in order to increase the ultimate strength (correction value) (Pu'), it is necessary to increase the ultimate strength (Pu) and/or the plasticity (μ) of the load-bearing wall. The ultimate strength (Pu) typically increases when the value of the maximum load (Pmax) that the board can withstand in an in-plane shear test is increased, that is, when the maximum load-bearing strength (Pmax) of the load-bearing wall is increased. Therefore, a method of increasing the co-efficient of effective wall length is assumed in which the maximum load-bearing strength (Pmax) is increased and the ultimate strength (Pu) is increased accordingly. However, as will be described later, at present, it is significantly difficult to further increase the maximum load-bearing strength (Pmax) while maintaining the light weight of the low-density gypsum-based load-bearing board. As another possible method, as described in Patent Document 3, a method of increasing the co-efficient of effective wall length are considered in which the value of the plasticity (μ) is increased and the ultimate strength (Pu) is indirectly increased accordingly. However, for this purpose, it is necessary to further increase the value of the ultimate displacement (δu) of the load-bearing wall, and as will be described later, this is also significantly difficult at present.

As a measure to increase the ultimate strength (correction value) (Pu') of the load-bearing wall and to improve the co-efficient of effective wall length, a method of reinforcing a board is described in Patent Document 1, in which a reinforcement material or a stiffening material such as a metal plate is provided at a nailed part to prevent destruction or rupture of the nailed part. According to the wooden load-bearing wall using the reinforcement material or the stiffening material, it is considered possible to construct a wooden load-bearing wall that exhibits a relatively high co-efficient of effective wall length, by improving the toughness and the deformation followability of the load-bearing board and increasing the ultimate strength (correction value) (Pu'), without relying on the increase in the maximum load that the board can withstand in the performance test.

In the present specification, the term "gypsum-based load-bearing board" is used to include not only the (regular) gypsum board, the reinforced gypsum board, and the structural gypsum board that are specified in JIS A 6901 (gypsum board products), but also the gypsum-based board such as the low-density gypsum-based load-bearing board (Patent Document 3) and the gypsum-based load-bearing board described in Japanese Patent No. 6412431 (Patent Document 4), in which the outer surface or the outer layer of the gypsum core portion (core material portion) using gypsum as a main material is covered with a paper such as a gypsum board base paper.

RELATED ART DOCUMENTS

Patent Document

Patent Document 1: International Patent Publication No. WO2019/203148 A1

Patent Document 2: Japanese Patent No. 5642948

Patent Document 3: specification and drawings of PCT/JP2021/14227

Patent Document 4: Japanese Patent No. 6412431

Non-Patent Document

Non-Patent Document 1: Allowable Stress Design for Wooden Framework Construction Method Housing [1] (2017 edition), pages 63 and 300

SUMMARY OF THE INVENTION

Problems to be Solved by the Invention

According to the load-bearing wall structure (Patent Document 1) in which the ultimate strength (correction value) (Pu') is increased by using the reinforcement material or the stiffening material, a step of additionally attaching the reinforcement material or the stiffening material to the surface of the load-bearing board must be added to the board manufacturing process, or such a step must be additionally performed in the construction of the wooden load-bearing wall. This kind of step may complicate the manufacturing process of the gypsum-based board or deteriorate the workability of the construction work.

In order to further improve the co-efficient of effective wall length of the wooden load-bearing wall using the low-density gypsum-based load-bearing board as the load-bearing board without relying on the reinforcement material or the stiffening material, it is considered necessary to further increase the ultimate strength (Pu) and/or the plasticity (μ) of the load-bearing wall and to further increase the ultimate strength (correction value) (Pu') of the load-bearing wall, as described above. The ultimate strength (Pu) typically increases when the maximum load-bearing strength (Pmax) of the load-bearing wall is increased. Therefore, a method of increasing the co-efficient of effective wall length is considered in which the maximum load-bearing strength (Pmax) is increased and the ultimate strength (Pu) is increased accordingly. However, there is a concern that when the maximum load-bearing strength (Pmax) is increased, the plasticity (μ) decreases and the ultimate strength (correction value) (Pu') actually decreases. In addition, an increase in the maximum load-bearing strength (Pmax) is usually accompanied by an increase in the surface density of the load-bearing board. However, because gypsum-based load-bearing boards typically have a self-weight exceeding 20 kg in their standard dimensions (width: approximately 910 mm, height: approximately 3,030 mm), an increase in the surface density of the board is considered to be undesirable in practical use from the viewpoint of the workability of the wooden load-bearing wall, considering the actual condition of the work in which workers in construction work manually fix the load-bearing board to the wall base of the wooden load-bearing wall. That is, it is highly difficult in practical use to substantially increase the maximum load-bearing strength (Pmax) without substantially decreasing the plasticity (μ) and the ultimate strength (correction value) (Pu') and substantially increasing the surface density.

Based on the technique described in Patent Document 3, it may theoretically be possible to increase the value of the plasticity (μ) by further increasing the value of the ultimate displacement (δu) of the load-bearing wall, thereby increasing the ultimate strength (Pu). However, there is a limit to further increasing the ultimate displacement (δu) by means such as decreasing the surface density, and at present, there is no knowledge of an effective means to further increase only the value of the ultimate displacement (δu) without significantly decreasing the lateral nail resistance, the maximum load-bearing strength (Pmax), or the yield strength (Py). Therefore, it is significantly difficult at present to further increase the value of the ultimate displacement (δu) and increase the value of the plasticity (μ).

The present disclosure is made in view of such circumstances, and an object of the present disclosure is to provide a gypsum-based load-bearing board for a wooden load-bearing wall that can increase the ultimate strength (correction value) (Pu') of the load-bearing wall and increase the short-term reference shear strength (P0) and the co-efficient of effective wall length of the load-bearing wall, without additionally attaching a reinforcement material or a stiffening material, without increasing the surface density (specific gravity and/or board thickness) of the board itself, and without further increasing the ultimate displacement (δu) of the load-bearing wall, in the aforementioned low-density gypsum-based load-bearing board having a reduced surface density while maintaining a relatively high lateral nail resistance.

It is also an object of the present disclosure to provide a load-bearing wall structure of a wooden building using such a gypsum-based board as a load-bearing board and a method of constructing a wooden load-bearing wall.

It is further an object of the present disclosure to provide a method of increasing the co-efficient of effective wall length of a wooden load-bearing wall that can increase the ultimate strength (correction value) (Pu') of the load-bearing wall and can increase the short-term reference shear strength (P0) and the co-efficient of effective wall length of the load-bearing wall, without relying on the reinforcing or stiffening action of the reinforcement material or the stiffening material additionally provided to the gypsum-based board, without relying on the increase in the surface density of the gypsum-based board itself, and without further increasing the ultimate displacement (δu) of the load-bearing wall, with regard to the load-bearing wall using the aforementioned low-density gypsum-based load-bearing board.

Means for Solving the Problem

In order to achieve the above objectives, the present disclosure provides: a gypsum-based load-bearing board fastened, by a fastener, to a wooden wall base used in a wooden framework construction method or in a wooden framework wall construction method, the gypsum-based load-bearing board comprising: a main material or a core material formed from a board-shaped hardened gypsum; and a paper covering at least front and back surfaces the main material or the core material, wherein the gypsum-based load-bearing board has a surface density specified as a mass per unit area of a wall surface, in a range from 6.5 kg/m$^2$ to 8.9 kg/m$^2$; a lateral nail resistance of 500 N or more; and a compressive strength of at least 6.5 N/mm$^2$, wherein the main material or the core material contains an inorganic fiber and an organic-based strength enhancer, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of a wooden load-bearing wall that is formed by fastening the gypsum-based load-bearing board, by a fastener, to a wooden wall base, the test piece having a wall length of 1.82 m.

According to the gypsum-based load-bearing board of the present disclosure, an inorganic fiber and an organic-based strength enhancer are contained to ensure a minimum physical property (lateral nail resistance: 500 N or more) as the gypsum-based load-bearing board, while the surface density of the board is rather reduced and set to a relatively low value (6.5 to 8.9 kg/m$^2$). In the following description of the present specification, the term "minimum physical property as the gypsum-based load-bearing board" means a lateral nail resistance of 500 N or more.

The above value of the surface density (6.5 to 8.9 kg/m$^2$) is considerably smaller than the surface density (approximately 9.4 kg/m$^2$) of conventional gypsum-based load-bearing boards such as the structural gypsum board. With such surface density, the specific gravity and/or the board thickness of the gypsum-based load-bearing board can be reduced, thereby reducing the self-weight of the load-bearing wall or reducing the wall thickness. On the other hand, such reduction of the surface density is a condition contrary to the conventional method of increasing the co-efficient of effective wall length that increases the short-term reference shear strength (P0) and the co-efficient of effective wall length of the load-bearing wall (that is, the conventional method of increasing the co-efficient of effective wall length that increases the maximum load-bearing strength (Pmax) by increasing the specific gravity and/or the board thickness, thereby increasing the short-term reference shear strength (P0)). However, as described in Patent Document 3, when the surface density is reduced while ensuring the minimum physical property as the gypsum-based load-bearing board (lateral nail resistance: 500 N or more), the toughness and the deformation followability potentially possessed by the gypsum-based load-bearing board become apparent in the plastic range, and as a result, the ultimate displacement (δu) and the plasticity (μ) of the load-bearing wall are increased instead, thereby increasing the ultimate strength (correction value) (Pu') of the load-bearing wall, so that the short-term reference shear resistance (P0) and the co-efficient of effective wall length can be increased without necessarily increasing the maximum load-bearing strength (Pmax).

According to the present disclosure, the main material or the core material contains a predetermined amount of the inorganic fiber and the organic-based strength enhancer so as to exhibit the lateral nail resistance of 500 N or more at the surface density within the range of 6.5 kg/m$^2$ to 8.9 kg/m$^2$. By maintaining the lateral nail resistance of 500 N or more, a desired yield strength can be maintained despite a decrease in the surface density. The amount of the inorganic fiber is 0.3 parts by weight to 5 parts by weight, and preferably 2 parts by weight to 4 parts by weight, based on 100 parts by weight of calcined gypsum. Examples of the inorganic fiber contained include glass fiber, carbon fiber, and the like.

When the glass fiber is used, glass fiber having a diameter of 5 μm to 25 μm and a length of 2 μm to 25 mm may be suitably used.

Furthermore, the inventors of the present application have discovered the phenomenon that the initial stiffness (K) of the load-bearing wall increases due to the increase in the compressive strength of the gypsum-based load-bearing board through a number of experiments, and based on the findings, through intensive research, it has been found that the compressive strength of the gypsum-based load-bearing board is increased to a value of 6.5 $N/mm^2$ or more to increase the initial stiffness (K) of the load-bearing wall, thereby reducing the yield point displacement (δv) of the load-bearing wall without significantly reducing the ultimate displacement (δu) of the load-bearing wall, thereby increasing the plasticity (μ) relatively significantly, leading to the present disclosure.

That is, according to the present disclosure, by increasing the compressive strength of the gypsum-based load-bearing board to a value of 6.5 $N/mm^2$ or more and increasing the initial stiffness (K) of the load-bearing wall to a value of, for example, 2.0 $kN/10^{-3}$ rad or more, and thereby reducing the value of the yield point displacement (δv) to a value of, for example, $7.2\times10^{-3}$ rad or less, the value of the plasticity (μ) can be relatively significantly increased in combination with a relatively high value of the ultimate displacement (δu), and as a result, it is relatively easy to ensure a value of 7.7 kN or more as the correction value (Pu') of the ultimate strength.

In the load-bearing wall using the low-density gypsum-based load-bearing board according to Patent Document 3, the initial stiffness (K) is a value less than 2.0 $kN/10^{-3}$ rad (for example, 1.9 $kN/10^{-3}$ rad). The aforementioned structural gypsum board is a gypsum-based load-bearing board developed to increase the lateral nail resistance as desired in order to prevent tear destruction of the gypsum-based load-bearing board due to changes in the relative position between the gypsum-based load-bearing board and the fastener that may occur during excitation, focusing on the load-bearing strength factor of the lateral nail resistance. The low-density gypsum-based load-bearing board of Patent Document 3 is intended to increase the plasticity (μ) and the ultimate strength (correction value) (Pu') of the gypsum-based load-bearing board by reducing the surface density while ensuring the desired lateral nail resistance, to make the toughness and the deformation followability potentially possessed by the gypsum-based load-bearing board become apparent in the plastic range. None of them focused on or considered the compressive strength of the compressive strength or the initial stiffness in the elastic range of the gypsum-based load-bearing board as a load-bearing strength improvement factor, nor did they examine or study the structural relationship between the initial stiffness of the load-bearing wall and the compressive strength of the gypsum-based load-bearing board.

In contrast, according to the experiments by the inventors of the present application, the compressive strength can be increased as desired by increasing the surface density, but because increasing of the surface density tends not only to increase the self-weight of the board but also to decrease the ultimate displacement, it is desirable to increase the compressive strength to an appropriate value by mainly using the action of increasing the compressive strength by the organic organic-based strength enhancer. That is, in the present disclosure, the compressive strength is set as desired, mainly, by setting an appropriate surface density and by the action of increasing the compressive strength by containing the organic-based strength enhancer. The amount of the organic-based strength enhancer is 0.3 to 15 parts by weight, and preferably 1 to 13 parts by weight, based on 100 parts by weight of calcined gypsum. As the organic-based strength enhancer, for example, starch, polyvinyl acetate, polyvinyl alcohol, polyacrylic, and the like may be suitably used. As the starch, either unprocessed starch or processed starch may be used. Examples of the processed starch include starch subjected to physical treatment, chemical treatment, or enzymatic treatment. As the starch subjected to physical treatment, a-starch may be suitably used. As the starch subjected to chemical treatment, oxidized starch, phosphate esterified starch, urea phosphate esterified starch, hydroxypropylated phosphate cross-linked starch, hydroxyethylated starch, hydroxypropylated starch, cationized starch, acetylated starch, may be suitably used.

The known factors that may change the compressive strength of the gypsum-based load-bearing board include a kneading state of gypsum slurry (kneading time, kneading temperature, and the like); type and amount of impurities contained in gypsum raw materials; cross-sectional properties, densification, and uniformity of gypsum cores; amount, size, and dispersion state of bubbles contained in gypsum cores; moisture content or water content of gypsum cores; specific gravity of gypsum cores; and the like. Although these factors may be used as control factors to increase or decrease the compressive strength, they are not only closely related to the manufacturing conditions (types of gypsum raw materials, types and amounts of additives such as foaming agents, water temperature of kneading water, air temperature, humidity, and the like), but also to the overall quality of gypsum cores. Therefore, they are not the control factors of the properties that can be used specifically for a specific application in which a desired compressive strength (compressive strength of 6.5 $N/mm^2$ or more) is given to the gypsum-based load-bearing board at a relatively low surface density (surface density within the range of 6.5 to 8.9 $kg/m^2$), and in which a desired lateral nail resistance (lateral nail resistance of 500 N or more) is given to the gypsum-based load-bearing board in cooperation with the inorganic fiber. In contrast, the organic-based strength enhancer can be used specifically for such applications, and can be added additionally to the gypsum slurry during the manufacturing process, thus providing a realistic and effective means of increasing the compressive strength of the gypsum core.

Preferably, the load-bearing board ensures the value of 2.0 $kN/10^{-3}$ rad or more as the initial stiffness (K) of the load-bearing wall measured by the in-plane shear test, or ensures the value of $7.2\times10^{-3}$ rad or less as the yield point displacement (δv) of the load-bearing wall measured by the in-plane shear test. Alternatively, the load-bearing board has the compressive strength of 6.5 $N/mm^2$ or more, so as to ensure the value of 2.0 $kN/10^{-3}$ rad or more as the initial stiffness (K) and the value of $7.2\times10^{-3}$ rad or less as the yield point displacement (δv). For example, in the gypsum-based load-bearing board according to the present disclosure, assuming that the yield point displacement (δv)=$6.0\times10^{-3}$ rad, the initial stiffness (K)=2.5 $kN/10^{-3}$ rad, the ultimate strength Pu=15.0 kN, the ultimate displacement (δu)=$30\times10^{-3}$ rad, the plasticity (μ)=5.0, and the variation coefficient β=1.0, the ultimate strength (correction value) (Pu') is 9.0 kN. In contrast, when it is set, as in the case of the low-density gypsum-based load-bearing board described above, that the initial stiffness (K)=1.9 $kN/10^{-3}$ rad (<2.0 $kN/10^{-3}$ rad), even when the ultimate strength Pu=15.0, the ultimate displacement (δu)=$30\times10^{-3}$ rad, and the variation coefficient β=1.0, the yield point displacement (δv)=$7.8\times10^{-3}$ rad and the plasticity (μ)=3.8, and the ultimate strength (correction value) (Pu') is only approximately 7.7 kN. That is, by increasing the compressive strength of the load-bearing board and increasing the initial stiffness (K), the ultimate strength (correction value) (Pu') can be relatively significantly increased, and the short-term reference shear strength (P0) and the co-efficient of effective wall length can be relatively significantly increased.

In the present disclosure, the compressive strength may be set preferably to a value within the range of 7.5 to 13.0 $kN/mm^2$, and more preferably to a value of 8.0 $kN/mm^2$ or more. Also in the present disclosure, the initial stiffness may be set preferably to a value within the range of 2.2 $kN/10^{-3}$ rad to 4.0 $kN/10^{-3}$ rad, and more preferably to a value of 2.4 $kN/10^{-3}$ rad or more. Furthermore, according to the present disclosure, the yield point displacement (δv) may be set preferably to a value within the range of $3.5\times10^{-3}$ rad to $7.2\times10^{-3}$ rad, and more preferably to a value of $6.5\times10^{-3}$ rad or less. Preferably, according to the load-bearing wall provided with the gypsum-based load-bearing board according to the present disclosure, a value of 4.2 or more and 10.0 or less, preferably 4.3 or more, can be obtained as the plasticity (μ) measured by the in-plane shear test; a value of $20\times10^{-3}$ rad or more, preferably $22\times10^{-3}$ rad or more, can be obtained as the ultimate displacement (δu) of the load-bearing wall measured by the in-plane shear test; and a value of 7.7 kN or more and larger than the ultimate strength (correction value) (Pu'), preferably 8.0 kN or more, can be obtained as the yield strength (Py) measured by the in-plane shear test. According to the experiments of the inventors of the present application, as the initial stiffness (K) increases, the yield strength (Py) also tends to increase, and accordingly, as in the case of the low-density gypsum-based load-bearing board, the yield strength (Py) is typically larger than the ultimate strength (correction value) (Pu'). The ultimate displacement (δu) of the load-bearing wall is an index indicating the toughness and the deformation followability of the load-bearing wall in the plastic range. According to "Performance Test and Evaluation Methodology for Wooden load-bearing walls and Their Co-efficient of effective wall length", the ultimate displacement (δu) is set to 1/15 rad when the load does not drop beyond 1/15 rad in the in-plane shear test and the ultimate displacement value cannot be obtained. Therefore, the maximum value of the ultimate displacement (δu) is 1/15 rad ($66.7\times10^{-3}$ rad).

Thus, according to the load-bearing wall using the gypsum-based load-bearing board of the present disclosure, not only the toughness and the deformation followability of the gypsum-based load-bearing board in the plastic range are improved and the ultimate strength (correction value) (Pu') is increased by a decrease in surface density while the minimum physical properties as the gypsum-based load-bearing board are secured, but also the ultimate strength (correction value) (Pu') is further increased by the increase in the initial stiffness (K) and the decrease in the yield point displacement (δv), whereby the short-term reference shear strength (P0) and the co-efficient of effective wall length of the load-bearing wall can be relatively significantly increased, without additionally attaching the reinforcement material or the stiffening material and without increasing the surface density of the gypsum-based load-bearing board. In addition, in the load-bearing board, because at least the front and back surfaces of the main material or the core material are covered with the paper in the same manner as the structural gypsum board and the low-density gypsum-based gypsum-bearing board described above, the gypsum board can be simply manufactured in a conventional gypsum board manufacturing line. Preferably, the gypsum-based gypsum-bearing board of the present disclosure has a laminated structure in which the surface or the surface layer of the core material is covered with a gypsum board base paper. The term "front and back surfaces" means the front surface and the back surface of the board excluding the end surface and the side surface of the end edge and the side edge (that is, the four outer edges) of the board.

Preferably, the board thickness of the gypsum-based load-bearing board is set to a value of 7.5 mm or more and less than 12 mm (more preferably, a value of 8.5 mm or more and 10 mm or less), for example, to 9.5 mm or 9.0 mm. The gypsum-based load-bearing board having such a board thickness is advantageous in reducing the wall thickness of the wooden load-bearing wall, as compared with a structural gypsum board requiring a board thickness of 12 mm or more. As desired, the hardened gypsum has the lateral nail resistance of 980 N or less.

Preferably, by using the gypsum-based load-bearing board, the ultimate displacement (δu) can be $24\times10^{-3}$ rad or more (preferably $26\times10^{-3}$ rad or more) as the ultimate displacement (δu) of the load-bearing wall measured by the in-plane shear test using a test piece of the load-bearing wall having a length of 1.82 m. The value of the ultimate displacement (δu) set at a relatively high value is highly advantageous for increasing the short-term reference shear strength (P0) and the co-efficient of effective wall length, because the value of the plasticity (μ) increases relatively significantly in combination with the increase in the initial stiffness (K) and the decrease in the yield point displacement (δv) of the load-bearing wall.

More preferably, the specific gravity of the gypsum-based load-bearing board is set to a value within the range of 0.65 to 0.96, preferably within the range of 0.7 to 0.9 (more preferably, a value within the range of 0.7 to 0.8). According to the gypsum-based load-bearing board with such specific gravity, for example, the board can be reduced in weight compared with the gypsum-based board embodiment of Patent Document 4 (for example, "EX board" (trade name) manufactured by Yoshino Gypsum Co., Ltd.) in which the board thickness is less than 12 mm, but the specific gravity is 1.0 or more, and accordingly the self-weight is relatively large. Therefore, it is advantageous in reducing the weight of the wooden load-bearing wall or in improving the workability and the like in the installation or construction of the wooden load-bearing wall.

In the preferred embodiment of the present disclosure, the core material (the gypsum core portion) of the gypsum-based load-bearing board contains an organopolysiloxane compound as a load-bearing deterioration inhibitor to prevent the deterioration in the load-bearing strength. With such a load-bearing board, it is possible to provide a load-bearing board that can be constructed on an outdoor wall of a wooden exterior wall, as in the case of the gypsum-based load-bearing board described in Patent Document 4.

The present disclosure also provides a wooden load-bearing wall having a structure in which the gypsum-based load-bearing board is fastened to a wooden wall base used in a wooden framework construction method or in a wooden framework wall construction method, by a fastener such as nails and screws. The present disclosure further provides a method of constructing a wooden load-bearing wall in which the gypsum-based load-bearing board is fastened, by the fastener, to a wooden wall base used in a wooden framework construction method or in a wooden framework wall construction method.

According to the wooden load-bearing wall and the construction method, the surface density of the gypsum-based load-bearing board is reduced by reducing the specific gravity and/or the board thickness, thereby reducing the self-weight of the load-bearing wall or reducing the wall thickness. In addition, according to such a wooden load-bearing wall, as described above, not only the toughness and the deformation followability of the gypsum-based board (in the plastic range) are improved by reducing the density of the gypsum-based board, and the value of the ultimate displacement (δu) increases, but also the initial stiffness (K) of the load-bearing wall increases by increasing the compressive strength of the gypsum-based board, thereby reducing the value of the yield point displacement (δv). As a result, the value of the plasticity (μ) increases relatively significantly due to the synergistic effect between the relatively small value of the yield point displacement (δv) and the relatively large value of the ultimate displacement (δu), and thus it is possible to relatively easily ensure a value of 7.7 kN or more as the ultimate strength (correction value) (Pu') of the wooden load-bearing wall.

From another viewpoint, the present disclosure provides: a method of increasing a co-efficient of effective wall length of a wooden load-bearing wall constructed by fastening a gypsum-based load-bearing board, by a fastener, to a wooden wall base used in a wooden framework construction method or in a wooden framework wall construction method, the method of increasing the co-efficient of effective wall length including:

constituting a gypsum-based load-bearing board to include: a main material or a core material formed from a board-shaped hardened gypsum; and a paper covering at least front and back surfaces of the main material or the core material, wherein the gypsum-based load-bearing board has a surface density or a surface weight, specified as a mass per unit area of a wall surface, in a range from 6.5 kg/m$^2$ to 8.9 kg/m$^2$; a lateral nail resistance of 500 N or more; and a compressive strength of at least 6.5 N/mm$^2$ or more, wherein the main material or the core material contains an inorganic fiber and an organic-based strength enhancer, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of the wooden load-bearing wall with a wall length of 1.82 m.

Preferably, the load-bearing board ensures the value of 2.0 kN/10$^{-3}$ rad or more as the initial stiffness (K) of the load-bearing wall measured by the in-plane shear test, or ensures the value of 7.2×10$^{-3}$ rad or less as the yield point displacement (δv) of the load-bearing wall measured by the in-plane shear test. Alternatively, the load-bearing board has the compressive strength of 6.5 N/mm$^2$ or more, so as to ensure the value of 2.0 kN/10$^{-3}$ rad or more as the initial stiffness (K) and the value of 7.2×10$^{-3}$ rad or less as the yield point displacement (δv). The compressive strength may be set preferably to a value within the range of 7.5 to 13.0 kN/mm$^2$ and more preferably to a value of 8.0 kN/mm$^2$ or more.

The initial stiffness may be set preferably to a value within the range of 2.2 kN/10$^{-3}$ rad to 4.0 kN/10$^{-3}$ rad and more preferably to a value of 2.4 kN/10$^{-3}$ rad or more. The yield point displacement (δv) may be set preferably to a value within the range of 3.5×10$^{-3}$ rad to 7.2×10$^{-3}$ rad and more preferably to a value of 6.5×10$^{-3}$ rad or less. Preferably, according to the load-bearing wall provided with the gypsum-based load-bearing board, a value of 4.2 or more and 10.0 or less, preferably 4.3 or more, can be obtained as the plasticity (μ) measured by the in-plane shear test; a value of 20×10$^{-3}$ rad or more, preferably 22×10$^{-3}$ rad or more, can be obtained as the ultimate displacement (δu) of the load-bearing wall measured by the in-plane shear test; and a value of 7.7 kN or more and larger than the ultimate strength (correction value) (Pu'), preferably 8.0 kN or more, can be obtained as the yield strength (Py) measured by the in-plane shear test.

Preferably, the board thickness of the gypsum-based load-bearing board is set to a value of 7.5 mm or more and less than 12 mm (more preferably, a value of 8.5 mm or more and 10 mm or less), for example, to a value of 9.5 mm or 9.0 mm. More preferably, the specific gravity of the gypsum-based load-bearing board is set to a value of 0.65 or more and 0.96 or less, and preferably to a value of 0.7 or more and 0.9 or less (more preferably, a value of 0.7 or more and 0.8 or less).

Effects of the Invention

According to the gypsum-based load-bearing board of the present disclosure, the toughness and the deformation followability of the gypsum-based board are improved by reducing the surface density, and the yield point displacement (δv) of the load-bearing wall formed by fastening the load-bearing board, by the fastener, to the wooden wall base is reduced, by increasing the initial stiffness (K) thereof, thereby increasing the ultimate strength (correction value) (Pu') and increasing the short-term reference shear strength (P0) and the co-efficient of effective wall length. In particular, the gypsum-based load-bearing board according to the present disclosure can be effectively used as a load-bearing board for further increasing the short-term reference shear strength (P0) and the co-efficient of effective wall length, without causing an increase in the wall thickness or an increase in the self-weight of the wall body, with respect to the load-bearing wall that is difficult to increase the value of the ultimate displacement (δu) or that can already exhibit the ultimate displacement (δu) close to the upper limit. Thus, according to the present disclosure, in the aforementioned low-density gypsum-based load-bearing board having a reduced surface density while maintaining a relatively high lateral nail resistance, it is possible to further increase the short-term reference shear strength (P0) and the co-efficient of effective wall length of the load-bearing wall, without additionally attaching the reinforcement material or the stiffening material, without increasing the surface density (the specific gravity and/or the board thickness) of the gypsum-based board, and without further increasing the value of the ultimate displacement (δu). Moreover, the gypsum-based load-bearing board of the present disclosure can be simply manufactured in a conventional gypsum board manufacturing line because at least the front and back surfaces of the main material or the core material are covered with the paper.

In addition, according to the load-bearing wall structure of the present disclosure, by using such a gypsum-based load-bearing board as a load-bearing board in a wooden load-bearing wall, the short-term reference shear strength (P0) and the co-efficient of effective wall length can be effectively increased, and the self-weight of the load-bearing wall can be reduced or the wall thickness can be reduced, by reducing the surface density of the gypsum-based load-bearing board.

Further, according to the method of constructing the wooden load-bearing wall according to the present disclosure, by using the gypsum-based load-bearing board of the above configuration as a load-bearing board in the wooden load-bearing wall, not only the short-term reference shear strength (P0) and the co-efficient of effective wall length can be effectively increased, but also the self-weight of the board can be reduced by reducing the surface density of the gypsum-based load-bearing board, and the workability and the like of the load-bearing wall can be improved.

Further, according to the method of increasing the co-efficient of effective wall length of a wooden load-bearing wall according to the present disclosure, the toughness and the deformation followability of the gypsum-based board can be improved by reducing the surface density while ensuring the minimum physical property (lateral nail resistance=500 N or more) as a gypsum-based load-bearing board, and the yield point displacement (δv) can be lowered by increasing the initial stiffness (K), thereby increasing the ultimate strength (correction value) (Pu') and increasing the short-term reference shear strength (P0) and the co-efficient of effective wall length. According to the method of increasing the co-efficient of effective wall length, with respect to the load-bearing wall using the low-density gypsum-based load-bearing board, the co-efficient of effective wall length can be increased, without relying on the reinforcement or stiffening by the reinforcement material or the stiffening material additionally provided to the gypsum-based board, without relying on the increase in the specific gravity and/or the board thickness of the gypsum-based board, and without depending significantly on the increase in the value of the ultimate displacement (δu).

BRIEF DESCRIPTION OF THE DRAWINGS

FIG. 1 is a diagram illustrating a load-deformation angle curve obtained by an in-plane shear test of a wooden load-bearing wall, as an envelope (indicated by a solid line), and illustrating a linear graph, indicated by a dash-dot line, in which the envelope of the load-deformation angle curve is converted to load-deformation angle characteristics of a total elastic-plastic model.

FIG. 4 is a diagram illustrating physical properties, compositions, and the like of the gypsum-based load-bearing board according to Examples and Comparative Example of the present disclosure.

DETAILED DESCRIPTION OF THE INVENTION

Hereinafter, a configuration of the wooden load-bearing wall of the preferred embodiment of the present invention will be described in detail with reference to the accompanying drawings.

Figure 2:
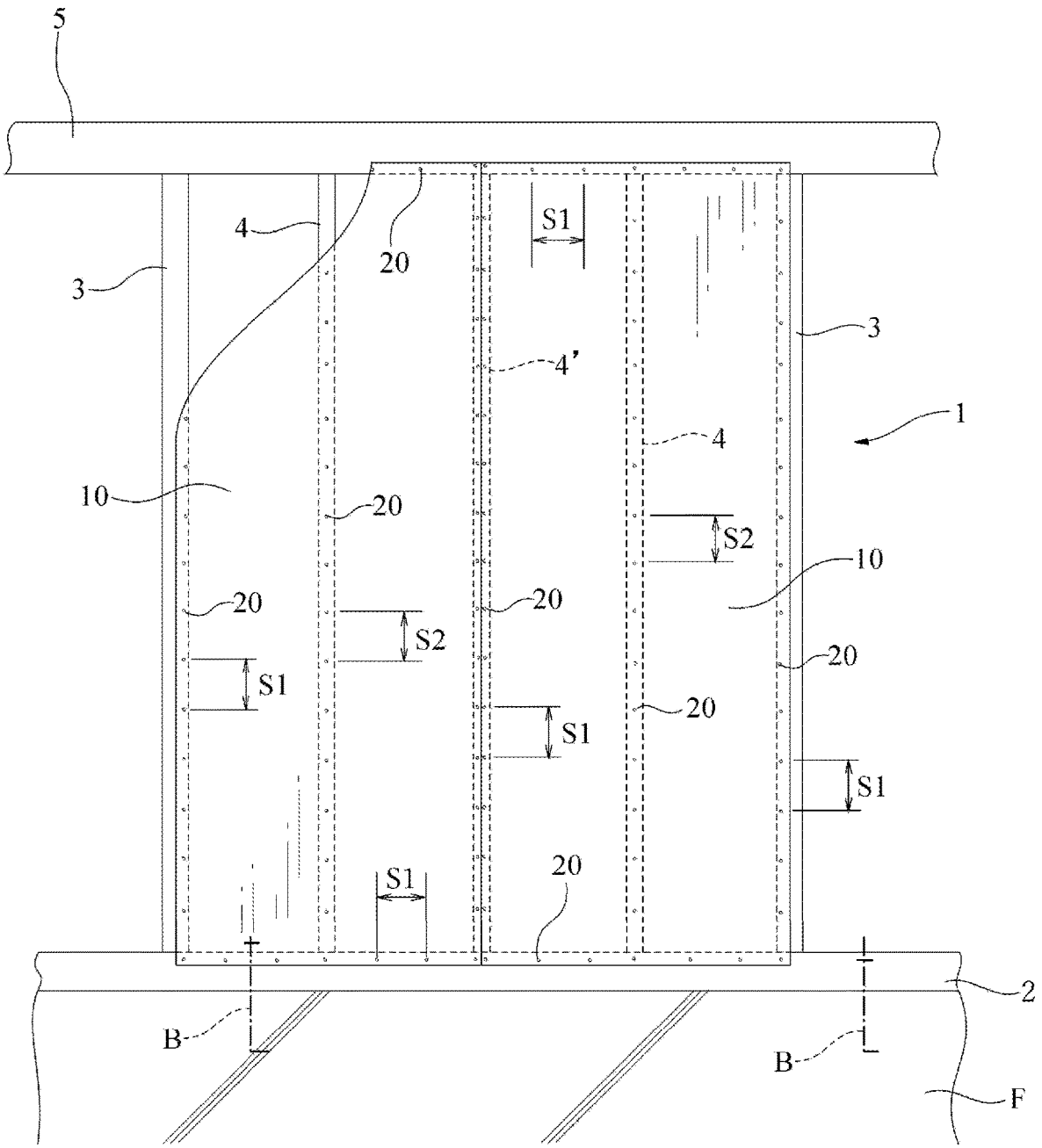
FIG. 2 is a front view schematically illustrating an embodiment of a load-bearing wall of a wooden building to which the present disclosure is applied.

FIG. 2 is a front view schematically illustrating the configuration of the wooden load-bearing wall (load-bearing wall) of the wooden building according to the embodiment of the present disclosure.

A load-bearing wall 1 illustrated in FIG. 2 is a wooden load-bearing wall of a wooden framework construction method that is constructed by fixing a load-bearing board 10 to a wooden framework on a fabric foundation F of a reinforced concrete (RC) structure. The load-bearing board 10 has dimensions of 9.5 mm in thickness, 910 mm in width, and approximately 2,800 to 3,030 mm in height (for example, approximately 2,900 mm), and has an surface density (for example, a surface density of 7.5 kg/m$^2$) within the range of 6.5 to 8.9 kg/m$^2$. The surface density (also called a surface weight) is the mass (weight) per unit area of the wall in front view of the wall. The load-bearing board 10 is a gypsum-based board that is constituted from a flat board-shaped gypsum core (gypsum core material) containing a predetermined amount of an inorganic fiber (glass fiber) and an organic-based strength enhancer (starch), and a gypsum board base paper (a paper) that covers both sides of the gypsum core.

The load-bearing wall 1 has a foundation 2 fixed to the upper surface of the fabric foundation F by anchor bolts B. The load-bearing wall 1 is typically constituted from the foundation 2, pillars 3 vertically provided on the foundation 2 at predetermined intervals, studs 4 and a joint stud 4', a lateral frame (beams, girts, outriggers, and gable outriggers) 5 supported on the upper end (or intermediate portion) of the pillars 3, and the aforementioned load-bearing board 10. The foundation 2, the pillars 3, the studs 4, the joint stud 4', and the lateral frame 5 constituting the framework are wood (square timber) of the cross-section of the member employed in conventional wooden construction buildings.

The load-bearing board 10 is fixed to the foundation 2, the pillars 3, the studs 4, the joint stud 4', and the lateral frame 5 by nails 20. The nails 20 are, for example, a plated iron nail (NZ nail: JIS A 5508). In this example, as the nails 20, for example, NZ50 nails (50 mm in length, 6.6 mm in head diameter, and 2.75 mm in shaft diameter) is used. The nails 20 are arranged at intervals S1 in the four outer circumferential areas of the load-bearing board 10 and at intervals S2 in the central band of the load-bearing board 10 extending vertically. Preferably, the interval S1 is set to a dimension within the range of 50 mm to 200 mm (for example, 75 mm), and the interval S2 is set to a dimension within the range of 50 mm to 300 mm (for example, 150 mm).

The gypsum core (the core material) of the load-bearing board 10 contains a predetermined amount of the inorganic fiber and the organic-based strength enhancer, and has the lateral nail resistance of 500 N or more. The amount of the inorganic fiber is 0.3 to 5 parts by weight, preferably 2 to 4 parts by weight, based on 100 parts by weight of calcined gypsum. Examples of the inorganic fiber contained include glass fiber, carbon fiber, and the like. When the glass fiber is used, glass fiber having a diameter of 5 to 25 μm and a length of 2 to 25 mm may be suitably used. The amount of the organic-based strength enhancer is 0.3 to 15 parts by weight, preferably 1 to 13 parts by weight, based on 100 parts by weight of calcined gypsum. Examples of the organic-based strength enhancer contained include starch, polyvinyl acetate, polyvinyl alcohol, polyacrylic, and the like. As the starch, either unprocessed starch or processed starch may be used. Examples of the processed starch include starch subjected to physical treatment, chemical treatment, or enzymatic treatment. As the starch subjected to physical treatment, a-starch may be suitably used. As the starch subjected to chemical treatment, oxidized starch, phosphate esterified starch, urea phosphate esterified starch, hydroxypropylated phosphate cross-linked starch, hydroxyethylated starch, hydroxypropylated starch, cationized starch, and acetylated starch, may be suitably used.

The composition and structure of the load-bearing board 10 are similar to those of "structural gypsum board" specified in JIS A 6901. However, the surface density of the load-bearing board 10 is the value within the range of 6.5 to 8.9 kg/m$^2$ (for example, 7.5 kg/m$^2$). Therefore, the load-bearing board 10 is basically different from the "structural gypsum board" of JIS A 6901, which requires the surface density of 9.4 kg/m$^2$ or more, as described above. Further, although the "reinforced gypsum board" specified in JIS A 6901 is known, the load-bearing board 10 is also basically different from the "reinforced gypsum board" because the "reinforced gypsum board" also requires the surface density of 9.4 kg/m$^2$ or more. Further, the load-bearing board 10 is also different from the other "gypsum boards" in that it has the main material or the core material that contains the inorganic fiber and the organic-based strength enhancers so as to exhibit the lateral nail resistance of 500 N or more. That is, the load-bearing board 10 does not fall under any of the "gypsum boards" specified in the current JIS A 6901. In the present specification, the load-bearing board 10 is specified or expressed as a "gypsum-based load-bearing board" in this sense.

Typically, a gypsum-based load-bearing board (including the "gypsum board", the "reinforced gypsum board", and the "structural gypsum board") formed by covering the front and back surfaces of a board-shaped main material or core material formed from a hardened gypsum with a paper is manufactured using a general purpose gypsum board manufacturing apparatus. The gypsum board manufacturing apparatus includes, for example, a mixer for preparing a gypsum slurry by mixing raw materials such as calcined gypsum, an adhesive aid, a curing accelerator, and foam (or foaming agent), and kneading water required for slurrying the calcined gypsum, as described in WO 2019/058936. The gypsum slurry is cast onto the gypsum board base paper (bottom sheet) on a conveyor belt of the gypsum board manufacturing apparatus, and the gypsum board base paper (top sheet) is laminated on the gypsum slurry. The consecutive laminate of the strip-like and three-layer structure thus formed is processed by each device included in the gypsum board manufacturing apparatus, such as a coarse cutting device, a forced drying device, a cutting device, or the like, and formed into a gypsum product having a predetermined dimension, that is, into a gypsum-based board in which both sides of the hardened body (that is, the gypsum core) of the gypsum slurry are covered with the gypsum board base paper. The specific gravity of the gypsum-based board is mainly controlled by the amount of the foam contained in the gypsum slurry.

With respect to the wooden load-bearing wall using, as the load-bearing board, the structural gypsum board, the reinforced gypsum board, and the (regular) gypsum board specified in JIS A 6901, examples of the co-efficient of effective wall length of the load-bearing board of Okabe-zukuri of the wooden framework structure as specified in the aforementioned Ministry of Construction Notification No. 1100 is as follows.

Structural gypsum board (Class A) 1.7
Structural gypsum board (Class B) 1.2
Reinforced gypsum board 0.9
(Regular) gypsum board 0.9

In addition, examples of the co-efficient of effective wall length (load-bearing walls with a vertical frame spacing of more than 50 cm) of the load-bearing wall of the framework wall construction method specified in the aforementioned the Ministry of Land, Infrastructure, Transport and Tourism Notification No. 1541 is as follows.

Structural gypsum board (Class A) 1.7
Structural gypsum board (Class B) 1.5
Reinforced gypsum board 1.3
(Regular) gypsum board 1.0

Thus, the values of the co-efficient of effective wall length specified in the Ministry of Construction or the Ministry of Land, Infrastructure, Transport and Tourism Notification are typically acceptable without performing individual performance tests. However, the structural gypsum board, the reinforced gypsum board, and the (regular) gypsum board, which are recognized as effective as load-bearing boards are limited to those having a board thickness of 12 mm or more. Therefore, when new material boards or gypsum-based boards having a board thickness of less than 12 mm are effectively used as the load-bearing board or when co-efficient of effective wall length other than the above is used, it is necessary to set the value of the co-efficient of effective wall length by performing the aforementioned performance tests.

As described above, the aforementioned structural gypsum board and the reinforced gypsum board specified in JIS A 6901 require physical properties with a surface density of 9.4 kg/m$^2$ or more and a specific gravity of 0.75 or more. This is considered to be an important condition for increasing the maximum load that the board can withstand and ensuring a high short-term allowable shear strength (and thus a high co-efficient of effective wall length) of the wooden load-bearing wall. In particular, in the structural gypsum board, which exhibits higher lateral nail resistance than the reinforced gypsum board, it has been considered that the surface density and the specific gravity cannot be reduced. In other words, it has been considered that ensuring the physical properties with the surface density of 9.4 kg/m$^2$ or more and the specific gravity of 0.75 or more was an essential condition for further increasing the co-efficient of effective wall length of the test piece of the load-bearing wall (the wooden load-bearing wall) obtained in the aforementioned in-plane shear test. However, in recent experiments by the inventors of the present application, it has been found that, in the gypsum-based board having the physical property (the lateral nail resistance) equivalent to that of the structural gypsum board by adding the inorganic fiber and the organic-based strength enhancer, the board thickness of the board is reduced, or the specific gravity of the gypsum core is reduced by adjusting the foam amount, thereby reducing the surface density, and as a result, the toughness or the deformation followability potentially possessed by the board itself becomes apparent. As a result, it is possible to effectively utilize the ultimate strength of the load-bearing wall and increase the plasticity of the load-bearing wall, thereby further improving the short-term allowable shear strength of the load-bearing wall. This point is described in Patent Document 3 above.

Recent experiments by the inventors of the present application have revealed that the initial stiffness of the load-bearing wall increases due to the increase in the compressive strength of the gypsum-based load-bearing board, thereby reducing the yield point displacement of the load-bearing wall, without significantly reducing the ultimate displacement of the load-bearing wall, and as a result, the plasticity of the load-bearing wall can be relatively significantly increased.

As described above, the compressive strength and the lateral nail resistance of the gypsum-based load-bearing board are increased by supplying the organic-based strength enhancer such as starch, polyvinyl acetate, polyvinyl alcohol, polyacrylic, and the like together with the inorganic fiber to a gypsum slurry kneading mixer, such that an appropriate amount of the organic-based strength enhancer and the inorganic fiber are contained in the gypsum slurry. The compounding of the organic-based strength enhancer to the gypsum slurry is an effective means of providing the desired compressive strength (the compressive strength of 6.5 N/mm$^2$ or more) to the gypsum-based load-bearing board while ensuring a relatively low surface density (the surface density within the range of 6.5 to 8.9 kg/m$^2$), and also providing the desired lateral nail resistance (the lateral nail resistance of 500 N or more) to the gypsum-based load-bearing board in cooperation with the inorganic fiber. Considering that the compounding of the organic-based strength enhancer does not significantly affect the overall quality of the gypsum-based load-bearing board, it is also a simple means and effective in real or practical use.

Figure 3:
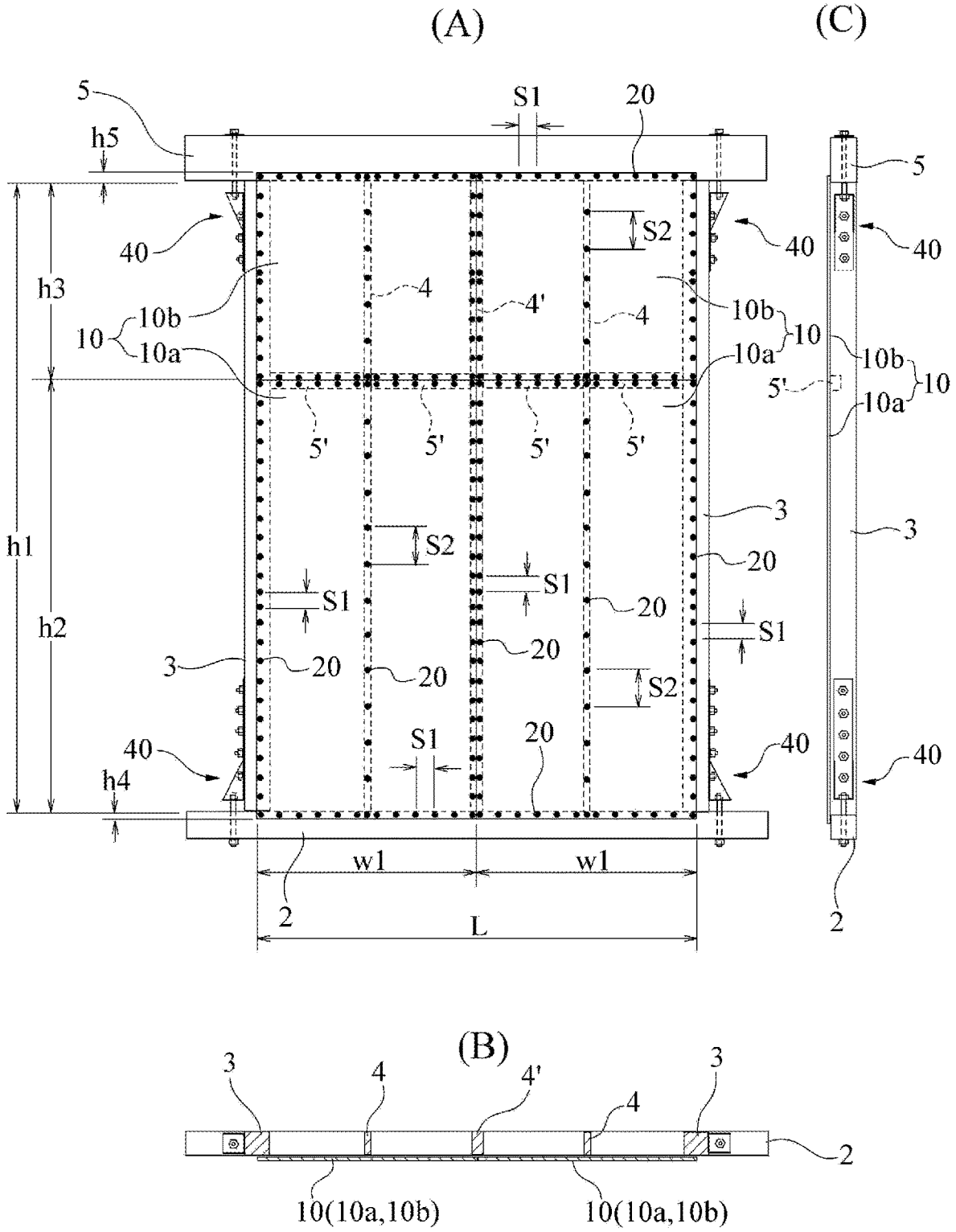
FIG. 3 is a front view, a cross-sectional view, and a side view illustrating a configuration of a test piece of the load-bearing wall used in the in-plane shear test of the load-bearing wall structure illustrated in FIG. 2.
Figure 5:
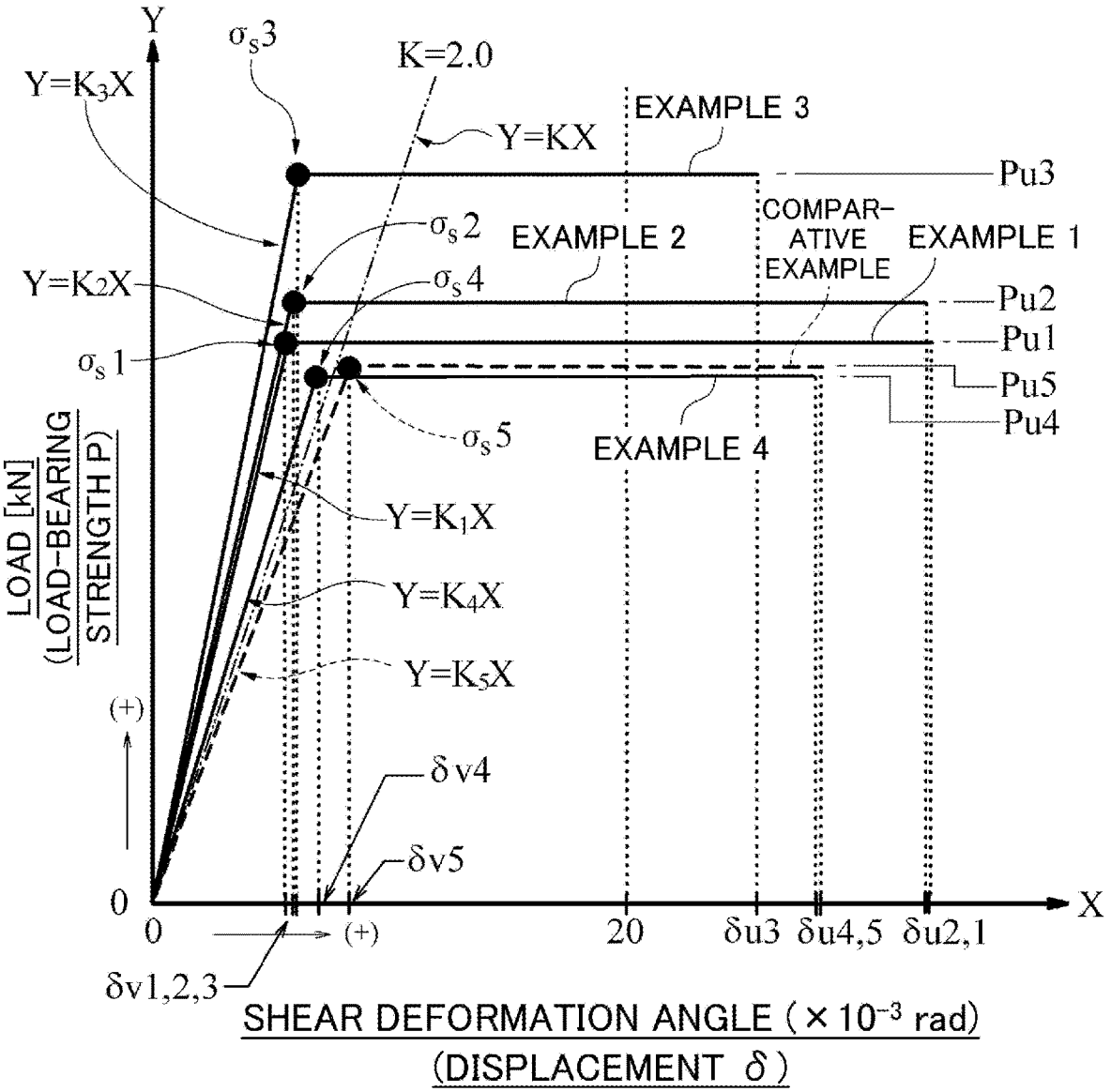
FIG. 5 is a diagram illustrating test results of the in-plane shear test of the load-bearing wall structure obtained by fixing the gypsum-based load-bearing board according to Examples 1 to 4 and the Comparative Example to a wooden structural framework, as the load-deformation angle characteristics of the total elastic-plastic model.

FIG. 3 is a front view, a cross-sectional view, and a side view illustrating a configuration of a test piece of the load-bearing wall used in the in-plane shear test of the load-bearing wall structure illustrated in FIG. 2. FIGS. 4 and 5 are diagrams illustrating the test results of the in-plane shear test. In FIG. 3, components of the test piece of the load-bearing wall that are equivalent or corresponding to the components illustrated in FIG. 2 are denoted by the same reference numerals.

In accordance with the specification for the test piece described in "Performance Test and Evaluation Methodology for Wooden load-bearing walls and Their Co-efficient of effective wall length", the inventors of the present application manufactured a test piece of the load-bearing wall having a load-bearing wall structure illustrated in FIG. 3 and having a wall width of 1,820 mm and a height of 2,730 mm (hereinafter referred to simply as "test piece"), as a test piece of the load-bearing wall structure illustrated in FIG. 2, and conducted the in-plane shear test using a non-loading test device.

The test piece illustrated in FIG. 3 has the main structure of a wooden framework assembly including the foundation 2 and the pillars 3 of cedar lumber having a cross-section of 105×105 mm, and the lateral frame 5 of pine lumber having a cross-section of 180×105 mm supported by the pillars 3. In the center between the pillars 3, the joint stud 4' of cedar lumber having a cross-section of 45×105 mm is disposed, and the studs 4 of cedar lumber having a cross-section of 27×105 mm are disposed between the pillars 3 and the joint stud 4'. Noggings 5' of cedar or pine lumber are disposed between the pillars 3 and the studs 4, and between the studs 4 and the joint stud 4'. As a test jig, a pull-on bracket 40 is provided at the joint of the foundation 2 and the pillars 3 and is also provided at the joint of the lateral frame 5 and the pillars 3. The foundation 2, the pillars 3, the joint stud 4', the studs 4, the lateral frame 5, and the noggings 5' constitute the framework members of the load-bearing wall structure, and a rectangular-shaped framework assembly is formed by these members (the framework members).

In the test piece illustrated in FIG. 3, a vertical length h1 between the foundation 2 and the lateral frame 5, a height h2 of the noggings 5', and a relative height h3 of the lateral frame 5 with respect to the noggings 5' are set to h1=2625 mm, h2=1,790 mm, and h3=835 mm, respectively. The spacing w1 between the pillars 3 and the joint stud 4' (the distance between the core pillars) is set to w1=910 mm, and the wall length L is set to 1.82 m. The load-bearing board 10 is divided vertically by the noggings 5'. A lower board 10*a* has a dimension of 910 mm in width and 1,820 mm in height, and an upper board 10*b* has a dimension of 910 mm in width and 865 mm in height. The overlapped length h4 and h5 of the boards 10*a* and 10*b* are set to 30 mm.

In the test piece illustrated in FIG. 3, the nails 20 for fastening the boards 10*a* and 10*b* to the foundation 2, the pillars 3, the joint stud 4', the lateral frame 5, and the noggings 5' are arranged at equal intervals (the interval S1=75 mm) throughout the peripheral portion of the boards 10*a* and 10*b*. The nails 20 for fastening the boards 10*a* and 10*b* to the studs 4 are arranged at equal intervals (the interval S2=150 mm) in the vertical center zone of the boards 10*a* and 10*b*. NZ50 nails 50 mm in length, 6.6 mm in head diameter, and 2.75 mm in shaft diameter) are used as the nails 20.

The inventors of the present application manufactured gypsum-based load-bearing boards of Examples 1 to 4 and Comparative Example illustrated in FIG. 4 as a sample, and carried out the in-plane shear test using the non-loading test device. As described above, the gypsum-based load-bearing boards of Examples 1 to 4 and Comparative Example are a board that is constituted from a flat board-shaped gypsum core (a gypsum core material) containing a predetermined amount of the inorganic fiber (glass fiber) and the organic-based strength enhancer (starch), and a gypsum board base paper (a paper) that covers both sides of the gypsum core, and has the surface density of approximately 7.4 kg/m$^2$ to approximately 8.7 kg/m$^2$. The gypsum-based load-bearing board of Comparative Example has a flat board-shaped gypsum core (a gypsum core material) containing a larger amount of the inorganic fiber (glass fiber) and the organic-based strength enhancer (starch) than the conventional gypsum-based load-bearing board (for example, the gypsum-based load-bearing board described in Patent Document 4). The test piece obtained by fixing the gypsum-based load-bearing board of Comparative Example to a wooden framework can increase the plasticity of the load-bearing wall 1 by increasing the ultimate displacement δu of the load-bearing wall 1 compared with the conventional gypsum-based load-bearing board, and can achieve a relatively high ultimate strength (correction value) Pu' (7.62 kN). That is, the board of Comparative Example is a gypsum-based load-bearing board equivalent to the gypsum-based load-bearing board of Patent Document 3. The amount of the inorganic fiber and the organic-based strength enhancer illustrated in FIG. 4 is presented in parts by weight based on 100 parts by weight of calcined gypsum.

In contrast, in the present disclosure, in order to further increase the ultimate strength (correction value) Pu', as described above, a configuration is further adopted in which the compressive strength of the board is increased to increase the initial stiffness K of the load-bearing wall 1, and the yield point displacement δu is reduced to increase the plasticity μ. That is, the test pieces (hereinafter referred to as the "test pieces of Examples 1 to 4") of the load-bearing wall 1 obtained by fixing the gypsum-based load-bearing boards of Examples 1 to 4 according to the present disclosure to the wooden framework have the compressive strength (6.5 to 11.1 kg/m$^2$) and the initial stiffness K (2.04 to 2.91 kN/10$^{-3}$ rad) higher than the compressive strength (6.0 kg/m$^2$) and the initial stiffness K (1.94 kN/10$^{-3}$ rad) of the gypsum-based load-bearing board of Comparative Example. As a result, the yield point displacement δu ($6.04\times10^{-3}$ rad to $6.80\times10^{-3}$ rad) of the test pieces of Examples 1 to 4 is significantly lower than the yield point displacement δu ($7.26\times10^{-3}$ rad) of the test piece of the load-bearing wall (hereinafter referred to as "test piece of Comparative Example") using the gypsum-based load-bearing board of Comparative Example. Moreover, the plasticity μ (4.32 to 5.78) of the test pieces of Examples 1 to 4 is significantly increased compared to the plasticity μ (4.15) of the test piece of Comparative Example.

As illustrated in FIG. 4, the ultimate strength (correction value) Pu' and the short-term allowable shear strength Pa of the test pieces of Examples 1 to 4 are Pu'=7.8 to 11.9 kN and Pa=5.85 to 8.92, and these values are significantly increased compared to the ultimate strength (correction value) (7.62 kN) and the short-term allowable shear strength Pa (5.72 kN) of the test piece of Comparative Example. Assuming that the reduction coefficient α=0.75, and the variation coefficient β=1.0, the co-efficient of effective wall length of the test pieces of Examples 1 to 4 is 1.64 to 2.50, which is significantly increased compared to the co-efficient of effective wall length (1.60) of the test piece of Comparative Example.

The test results of each test piece of Examples 1 to 4 and Comparative Example indicate that the maximum load (maximum load-bearing strength) Pmax (FIG. 1) is typically reached around when the deformation angle reaches $20\times10^{-3}$ rad; thereafter, it is not immediately destroyed; and then, through the application of repeated force, the deformation angle of the 0.8 Pmax in a post-peak region, that is, the ultimate displacements δu1 to δu5 (FIG. 5), is reached. The ultimate displacements δu1 to δu5 are the deformation angle of approximately $30\times10^{-3}$ rad. This means that after each test piece of Examples 1 to 4 and Comparative Example reaches the maximum load (the maximum load-bearing strength) Pmax, the plastic deformation is sustained through the application of repeated force until the deformation angle is approximately 1.5 times the deformation angle at the maximum load Pmax. As mentioned above, the persistence of the plastic deformation is considered to be caused by the fact that the toughness or the deformation followability potentially possessed by the gypsum plate itself became apparent by lowering the surface density while ensuring the minimum physical property (the lateral nail resistance: 500 N or more) as the gypsum-based load-bearing board.

In FIG. 5, the test results of each test piece of Examples 1 to 4 and Comparative Example are illustrated as a linear graph of the load-deformation angle characteristics of the total elastic-plastic model. In FIG. 5, the linear function line Y=KX in the linear elastic range set to the initial stiffness K=2.0 kN/$10^{-3}$ rad is illustrated as a reference line of the initial stiffness K in the present disclosure by a two-dot chain line. Further, in FIG. 5, the linear function lines Y=K1X to Y=K5X in the linear elastic range, the ultimate strengths Pu1 to Pu5, and the yield points σs1 to σs5 are illustrated for the test pieces of Examples 1 to 4 and Comparative Example. As illustrated in FIG. 4, the initial stiffnesses of the test pieces of Examples 1 to 4 are K4=2.04 kN/$10^{-3}$ rad at the minimum value and K3=2.91 kN/$10^{-3}$ rad at the maximum value. In contrast, the initial stiffness of the test piece of Comparative Example is K2=1.94 kN/$10^{-3}$ rad. The initial stiffness K is illustrated in FIG. 5 as a slope of the linear function line of Y=KX, and in the test pieces of Examples 1 to 4 exhibiting values of the initial stiffness K of 2.0 kN/$10^{-3}$ rad or more, each linear function line of Y=K1X to Y=K4X is illustrated in FIG. 5 as lines with a steeper slope than the reference line of the initial stiffness K=2.0 kN/$10^{-3}$ rad, and in Comparative Example exhibiting a value of the initial stiffness K5 less than 2.0 kN/$10^{-3}$ rad, the linear function line of Y=K5X is illustrated in FIG. 5 as a line with a gentler slope than the reference line of the initial stiffness K=2.0 kN/$10^{-3}$ rad. That is, in the test pieces of Examples 1 to 4 with the increased compressive strength, the initial stiffnesses K1 to K4 are values of 2.0 kN/$10^{-3}$ rad or more. As a result, relatively small yield point displacements δv1 to δv4 are obtained, and thereby, in combination with relatively large ultimate displacements δu1 to δu4 and ultimate strengths Pu1 to Pu4, relatively large ultimate strength (correction value) Pu', the short-term allowable shear strength Pa, and the co-efficient of effective wall length, are obtained, as illustrated in FIG. 4.

Figure 6:
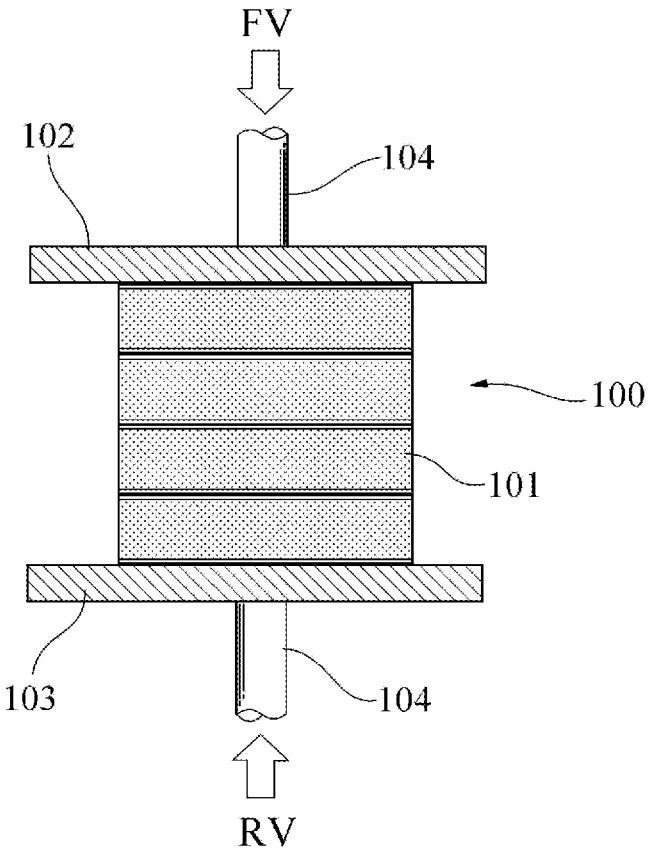
FIG. 6 is a partial front view of a test device conceptually illustrating a compressive strength measurement method of measuring compressive strength.

FIG. 6 schematically illustrates a method of measuring the compressive strength of the gypsum-based load-bearing board.

As illustrated in FIG. 6, in the measurement of the compressive strength of the gypsum-based load-bearing board performed by the inventors of the present application, the gypsum-based load-bearing boards of Examples and Comparative Example are cut into a flat plate having a dimension of 4 cm×4 cm to prepare a plurality of test pieces 101 for each of Examples and Comparative Example. Four pieces of the test pieces 101 were laminated without bonding to obtain a test piece laminate 100, and inserted between the upper and lower loading plates 102 and 103 of the measuring apparatus. A compressive load Fv (and reaction force Rv) in vertical direction was applied to the test piece laminate 100 by upper and lower loading rods 104, thereby fracturing the main material or the core material made of the hardened gypsum, that is, the gypsum core portion of the test pieces 101, and the compressive load Fv at the time of destruction was measured. As the measuring apparatus, a precision universal testing machine ("Autograph", Type: AG-10NKI, manufactured by Shimadzu Corporation) was used. The inventors of the present application measured the compressive load Fv at the time of compressive destruction of any of the test pieces 101 constituting the test piece laminate 100, and divided the measured value by the area of the test piece 100 (16 $cm^2$) for specifying the compressive strength of each of the gypsum-based load-bearing boards.

The compressive strength of the gypsum-based load-bearing board of each of Examples and Comparative Example specified is illustrated in FIG. 4. As illustrated in FIG. 4, the initial stiffness K of the gypsum-based load-bearing board of each of Examples and Comparative Example varies in response to the increase or decrease in the compressive strength, and the value of the initial stiffness K can be increased by increasing the compressive strength. Further, as illustrated in FIG. 4, the plasticity μ can be changed by the increase or decrease in the initial stiffness K, and the values of the ultimate strength (correction value) Pu' and the short-term allowable shear strength Pa can be changed. According to the properties of Examples 1 to 4 according to the present disclosure, by increasing the compressive strength of the gypsum-based load-bearing board to a value of 6.5 N/$mm^2$ or more, the ultimate strength (correction value) Pu' of a value of 7.8 kN or more can be obtained, as illustrated in FIG. 4.

As explained at the beginning of the present specification, the ultimate strength (correction value) Pu' is a value obtained by correcting the ultimate strength Pu based on the plasticity μ; the short-term allowable shear strength Pa is a value obtained by multiplying the ultimate strength (correction value) Pu' by a predetermined reduction coefficient α and variation coefficient ⊕; and the co-efficient of effective wall length is a value obtained by dividing the short-term allowable shear strength Pa by a predetermined standard value of the load-bearing strength (L×1.96). Accordingly, the co-efficient of effective wall length and the short-term allowable shear strength Pa are proportional to the value of the ultimate strength Pu and increase with the increase in the plasticity μ. The plasticity μ is proportional to the ultimate displacement δu and inversely proportional to the yield point displacement δv. Therefore, the co-efficient of effective wall length and the short-term allowable shear strength Pa can be increased by increasing the ultimate displacement δu or reducing the yield point displacement δv.

As illustrated in FIG. 4, the initial stiffness K of the test pieces of Examples 1 to 4 are larger than 2.0 kN/$10^{-3}$ rad; the initial stiffness K of the test piece of Comparative Example is smaller than 2.0 kN/$10^{-3}$ rad; and the yield point displacements δv1 to δv4 of the test pieces of Examples 1 to 4 are significantly smaller than the yield point displacement δv5 of the test piece of Comparative Example.

As illustrated in FIG. 4, the co-efficient of effective wall length and the short-term allowable shear strength Pa obtained by the test pieces of Examples 1 to 4 are significantly larger than the values of the co-efficient of effective wall length and the short-term allowable shear strength Pa obtained by the test piece of Comparative Example. It is considered that this is a result of the fact that the difference in the yield point displacement δv (therefore, the difference in the plasticity μ) contributes relatively significantly to the increase in the co-efficient of effective wall length and the short-term allowable shear strength Pa.

As described above, according to the load-bearing wall 1 of the above configuration, the load-bearing board 10 includes a main material or a core material formed from a board-shaped hardened gypsum containing an inorganic fiber and an organic-based strength enhancer so as to exhibit a lateral nail resistance of 500 N or more; and a paper covering at least front and back surfaces of the main material or the core material. The load-bearing board 10 has a surface density, specified as a mass per unit area of a wall surface, set in a range from 6.5 to 8.9 kg/$m^2$. As a result, the ultimate displacement δu of the load-bearing wall 1 is, for example, $28.89\times10^{-3}$ to $34.98\times10^{-3}$ rad. In contrast to the fact that the ultimate displacement δu of the load-bearing wall using the conventional gypsum-based load-bearing board (for example, the gypsum-based load-bearing board described in Patent Document 4) is approximately $20\times10^{-3}$ rad, as in the test piece of Comparative Example (δu=$30.10\times10^{-3}$ rad), the ultimate displacement δu of the load-bearing wall 1 increases significantly. Moreover, the yield point displacements δv1 to δv4 of the load-bearing wall 1 according to Examples 1 to 4 are $6.04\times10^{-3}$ to $6.80\times10^{-3}$ rad, which is significantly lower than the yield point displacement of δv5=$7.26\times10^{-3}$ rad of the load-bearing wall according to Comparative Example. As a result, the load-bearing boards 10 according to Examples 1 to 4 not only increase the plasticity μ by increasing the ultimate displacements δu1 to δu4 of the load-bearing wall 1, but also increase the plasticity μ by decreasing the yield point displacements δv1 to δv4 of the load-bearing wall 1. Therefore, even when the ultimate strength Pu and the ultimate displacements δu1 to δu4 of Examples 1 to 4 are equivalent to the values of Comparative Example, the plasticity μ can be increased by decreasing the yield point displacements δu1 to δu4, thereby increasing the co-efficient of effective wall length and the short-term allowable shear strength Pa.

Although the preferred embodiments and Examples of the present disclosure have been described in detail, the present disclosure is not limited to the above embodiments and Examples, and various changes or modifications are possible within the scope of the present disclosure described in the claims.

For example, the above embodiments and Examples relate to the load-bearing walls for the first floor level of a wooden building, but the present disclosure may similarly be applied to the load-bearing walls for the second or third floor level. In the case of the load-bearing wall at the second or third floor level, the lower end of the load-bearing board is fastened to the lateral frame or the like at the second or third floor level.

In addition, although the above embodiments and Examples relate to the wooden framework construction method and the load-bearing wall structure of Okabe-zukuri. However, the present invention may be applied to the load-bearing wall structure of Shinkabe-zukuri; or to the load-bearing wall structure of Yukagachi (floor preceding method) and Okabe-zukuri, of the wooden framework construction method. Alternatively, the present invention may be applied to the load-bearing wall structure of the wooden framework wall construction method. In this case, the load-bearing board is fastened to a vertical frame, a lower frame, an upper frame, or the like, instead of the foundation, the pillars, and the lateral frame.

In addition, the test piece illustrated in FIG. 3 has a structure in which the gypsum plate is divided into upper and lower portions and noggings are arranged at the intermediate position in the height direction, but the in-plane shear test may be performed using a gypsum plate of substantially the same height as the total height of the wooden framework assembly. In the latter case, it is considered that the short-term reference shear strength may be further increased.

Also, in the above-described embodiments and Examples, the load-bearing board is fastened to the wooden framework, such as the pillars, the lateral frame, and the like, by nails, but the load-bearing board may be fastened to the wooden framework by other types of fasteners, such as screws.

INDUSTRIAL APPLICABILITY

The present disclosure is applied to gypsum-based load-bearing boards in wooden buildings. In particular, the present disclosure is applied to a gypsum-based load-bearing board including a main material or a core material formed from a board-shaped hardened gypsum containing an inorganic fiber and an organic-based strength enhancer so as to exhibit a lateral nail resistance of 500 N or more. The present disclosure is also applied to a method of increasing the co-efficient of effective wall length of a wooden load-bearing wall using the gypsum-based load-bearing board. The present disclosure is further applied to a method of constructing a wooden load-bearing wall in which the gypsum-based load-bearing board is fastened to a wooden wall base used in a wooden framework construction method or in a wooden framework wall construction method, such that the load-bearing board is structurally held integrally by the wooden wall base. According to the present disclosure, the practical value or effect is remarkable because the co-efficient of effective wall length of the wooden load-bearing wall can be increased without additionally attaching the reinforcement material or the stiffening material, without increasing the specific gravity and/or the board thickness of the gypsum-based board, and without further increasing the value of the ultimate displacement (δu).

The present international application claims priority to Japanese Patent Application No. 2021-163783, filed Oct. 5, 2021, with the Japanese Patent Office, the contents of which are incorporated herein by reference in their entirety.

EXPLANATION OF REFERENCE NUMERALS

1 Load-bearing wall (wooden load-bearing wall)
2 Foundation
3 Pillar
4 Stud
4' Joint stud
5 Lateral frame (beam, girt, outrigger, and gable outrigger)
5' Nogging
10, 10*a*, 10*b* Load-bearing board (Gypsum-based load-bearing board)
20 Nail (fastener)

The invention claimed is:

1. A wooden load-bearing wall having a structure in which a gypsum-based load-bearing board is fastened, by a fastener, to a wooden wall base used in a wooden framework construction method or in a wooden framework wall construction method, wherein the gypsum-based load-bearing board includes a main material or a core material formed from a board-shaped hardened gypsum; and a paper covering at least front and back surfaces of the main material or the core material, wherein the gypsum-based load-bearing board has a surface density or a surface weight, specified as a mass per unit area of a wall surface, in a range from 6.5 kg/m$^2$ to 8.9 kg/m$^2$; a lateral nail resistance of 500 N or more; and a compressive strength of 6.5 N/mm$^2$ or more, wherein the main material or the core material contains glass fiber and starch, wherein an amount of the glass fiber in the gypsum-based load-bearing board is 3.0 to 3.5 parts by weight per 100 parts by weight of calcined gypsum, wherein an amount of the starch in the gypsum-based load-bearing board is 5.0 to 8.0 parts by weight per 100 parts by weight of calcined gypsum, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of the wooden load-bearing wall with a wall length of 1.82 m.

2. The wooden load-bearing wall according to claim 1, wherein the gypsum-based load-bearing board has the compressive strength of 6.5 N/mm$^2$ or more to provide an initial stiffness (K) of the gypsum-based load-bearing board 2.0 kN/10$^{-3}$ rad or more as measured by the in-plane shear test.

3. The wooden load-bearing wall according to claim 2, wherein at least one of physical properties of the wooden load-bearing wall measured by the in-plane shear test is provided by a setting of the surface density or the surface weight and of the lateral nail resistance and by a formulation of the inorganic fiber and the organic-based strength enhancer, and the physical properties include:

(1) the initial stiffness (K) that is 2.2 kN/10$^{-3}$ rad or more;

(2) a yield point displacement (δv) that is 7.2×10$^{-3}$ rad or less;

(3) a plasticity (μ) that is 4.2 or more;

(4) an ultimate displacement (δu) that is more than 20×10$^{-3}$ rad;

(5) a yield strength (Py) that is 7.7 kN or more and larger than the correction value (Pu') of the ultimate strength (Pu); and (6) the compressive strength that is 7.5 N/mm$^2$ or more.

4. The wooden load-bearing wall according to claim 3, wherein the wooden load-bearing wall has at least one of the physical properties including: the correction value (Pu') of the ultimate strength (Pu) is 8.0 kN or more; the ultimate displacement (δu) is more than 22×10$^{-3}$ rad; and the yield strength (Py) is 8.0 kN or more.

5. The wooden load-bearing wall according to claim 1, wherein the gypsum-based load-bearing board has a board thickness of less than 12 mm, a specific gravity of 0.96 or less, or both.

6. A method of constructing a wooden load-bearing wall in which a gypsum-based load-bearing board is fixed to a wooden wall base used in a wooden framework construction method or in a wooden framework wall construction method, the method of constructing a wooden load-bearing wall comprising:

fastening a gypsum-based load-bearing board, by a fastener, to a wooden wall base, in which the gypsum-based load-bearing board includes a main material or a core material formed from a board-shaped hardened gypsum; and a paper covering at least front and back surfaces of the main material or the core material, wherein the gypsum-based load-bearing board has a surface density or a surface weight, specified as a mass per unit area of a wall surface, in a range from 6.5 kg/m$^2$ to 8.9 kg/m$^2$; a lateral nail resistance of 500 N or more; and a compressive strength of 6.5 N/mm$^2$ or more, wherein the main material or the core material contains glass fiber and starch, wherein an amount of the glass fiber in the gypsum-based load-bearing board is 3.0 to 3.5 parts by weight per 100 parts by weight of calcined gypsum, wherein an amount of the starch in the gypsum-based load-bearing board is 5.0 to 8.0 parts by weight per 100 parts by weight of calcined gypsum, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of the wooden load-bearing wall with a wall length of 1.82 m.

7. The method of constructing a wooden load-bearing wall according to claim 6, wherein the gypsum-based load-bearing board has the compressive strength of 6.5 N/mm$^2$ or more to provide an initial stiffness (K) of the gypsum-based load-bearing board 2.0 kN/10$^{-3}$ rad or more as measured by the in-plane shear test.

8. The method of constructing a wooden load-bearing wall according to claim 7, wherein at least one of physical properties of the wooden load-bearing wall measured by the in-plane shear test is provided by a setting of the surface density or the surface weight and of the lateral nail resistance and by a formulation of the inorganic fiber and the organic-based strength enhancer, and the physical properties include:

(1) the initial stiffness (K) that is 2.2 kN/10$^{-3}$ rad or more;

(2) a yield point displacement (δv) that is 7.2×10$^{-3}$ rad or less;

(3) a plasticity (μ) that is 4.2 or more;

(4) an ultimate displacement (δu) that is more than $20\times10^{-3}$ rad;

(5) a yield strength (Py) that is 7.7 kN or more and larger than the correction value (Pu') of the ultimate strength (Pu); and (6) the compressive strength that is 7.5 N/mm$^2$ or more.

9. The method of constructing a wooden load-bearing wall according to claim 8, wherein the wooden load-bearing wall has at least one of the physical properties including: the correction value (Pu') of the ultimate strength (Pu) is 8.0 kN or more; the ultimate displacement (δu) is more than $22\times10^{-3}$ rad; and the yield strength (Py) is 8.0 kN or more.

10. The method of constructing a wooden load-bearing wall according to claim 6, wherein the gypsum-based load-bearing board has a board thickness of less than 12 mm, a specific gravity of 0.96 or less, or both.

11. A method of increasing a co-efficient of effective wall length of a wooden load-bearing wall constructed by fastening a gypsum-based load-bearing board, by a fastener, to a wooden wall base used in a wooden framework construction method or in a wooden framework wall construction method, the method of increasing the co-efficient of effective wall length comprising:

constituting a gypsum-based load-bearing board to include: a main material or a core material formed from a board-shaped hardened gypsum; and a paper covering at least front and back surfaces of the main material or the core material, wherein the gypsum-based load-bearing board has a surface density or a surface weight, specified as a mass per unit area of a wall surface, in a range from 6.5 kg/m$^2$ to 8.9 kg/m$^2$; a lateral nail resistance of 500 N or more; and a compressive strength of 6.5 N/mm$^2$ or more, wherein the main material or the core material contains glass fiber and starch, wherein an amount of the glass fiber in the gypsum-based load-bearing board is 3.0 to 3.5 parts by weight per 100 parts by weight of calcined gypsum, wherein an amount of the starch in the gypsum-based load-bearing board is 5.0 to 8.0 parts by weight per 100 parts by weight of calcined gypsum, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of the wooden load-bearing wall with a wall length of 1.82 m.

12. The method of increasing a co-efficient of effective wall length of a wooden load-bearing wall according to claim 11, wherein the gypsum-based load-bearing board has the compressive strength of 6.5 N/mm$^2$ or more to provide an initial stiffness (K) of the gypsum-based load-bearing board 2.0 kN/$10^{-3}$ rad or more as measured by the in-plane shear test.

13. The method of increasing a co-efficient of effective wall length of a wooden load-bearing wall according to claim 12, wherein at least one of physical properties of the wooden load-bearing wall measured by the in-plane shear test is provided by a setting of the surface density or the surface weight and of the lateral nail resistance and by a formulation of the inorganic fiber and the organic-based strength enhancer, and the physical properties include:

(1) the initial stiffness (K) that is 2.2 kN/$10^{-3}$ rad or more;

(2) a yield point displacement (δv) that is $7.2\times10^{-3}$ rad or less;

(3) a plasticity (μ) that is 4.2 or more;

(4) an ultimate displacement (δu) that is more than $20\times10^{-3}$ rad;

(5) a yield strength (Py) that is 7.7 kN or more and larger than the correction value (Pu') of the ultimate strength (Pu); and (6) the compressive strength that is 7.5 N/mm$^2$ or more.

14. The method of increasing a co-efficient of effective wall length of a wooden load-bearing wall according to claim 13, wherein the wooden load-bearing wall has at least one of the physical properties including: the correction value (Pu') of the ultimate strength (Pu) is 8.0 kN or more; the ultimate displacement (δu) is more than $22\times10^{-3}$ rad; and the yield strength (Py) is 8.0 kN or more.

15. The method of increasing a co-efficient of effective wall length of a wooden load-bearing wall according to claim 11, wherein the gypsum-based load-bearing board has a board thickness of less than 12 mm, a specific gravity of 0.96 or less, or both.

16. A gypsum-based load-bearing board fastened, by a fastener, to a wooden wall base used in a wooden framework construction method or in a wooden framework wall construction method, the gypsum-based load-bearing board comprising:

a main material or a core material formed from a board-shaped hardened gypsum; and a paper covering at least front and back surfaces of the main material or the core material, wherein the gypsum-based load-bearing board has a surface density or a surface weight, specified as a mass per unit area of a wall surface, in a range from 6.5 kg/m$^2$ to 8.9 kg/m$^2$; a lateral nail resistance of 500 N or more; and a compressive strength of 6.5 N/mm$^2$ or more, wherein the main material or the core material contains glass fiber an starch, wherein an amount of the glass fiber in the gypsum-based load-bearing board is 3.0 to 3.5 parts by weight per 100 parts by weight of calcined gypsum, wherein an amount of the starch in the gypsum-based load-bearing board is 5.0 to 8.0 parts by weight per 100 parts by weight of calcined gypsum, and wherein the gypsum-based load-bearing board has a correction value (Pu') of an ultimate strength (Pu) of 7.7 kN or more, the correction value (Pu') of the ultimate strength (Pu) being measured by an in-plane shear test using a test piece of a wooden load-bearing wall that is formed by fastening the gypsum-based load-bearing board to a wooden wall base, the test piece having a wall length of 1.82 m.

17. The gypsum-based load-bearing board according to claim 16, wherein the gypsum-based load-bearing board has the compressive strength of 6.5 N/mm$^2$ or more to provide an initial stiffness (K) of the gypsum-based load-bearing board 2.0 kN/$10^{-3}$ rad or more as measured by the in-plane shear test.

18. The gypsum-based load-bearing board according to claim 17, wherein at least one of physical properties of the wooden load-bearing wall measured by the in-plane shear test is provided by a setting of the surface density or the surface weight and of the lateral nail resistance and by a formulation of the inorganic fiber and the organic-based strength enhancer, and the physical properties include:

(1) the initial stiffness (K) that is 2.2 kN/$10^{-3}$ rad or more;

(2) a yield point displacement (δv) that is $7.2\times10^{-3}$ rad or less;

(3) a plasticity (μ) that is 4.2 or more;

(4) an ultimate displacement (δu) that is more than $20\times10^{-3}$ rad;

(5) a yield strength (Py) that is 7.7 kN or more and larger than the correction value (Pu') of the ultimate strength (Pu); and (6) the compressive strength that is 7.5 $N/mm^2$ or more.

19. The gypsum-based load-bearing board according to claim 18, wherein the wooden load-bearing wall has at least one of the physical properties including: the correction value (Pu') of the ultimate strength (Pu) is 8.0 kN or more; the ultimate displacement (δu) is more than $22\times10^{-3}$ rad; and the yield strength (Py) is 8.0 kN or more.

20. The gypsum-based load-bearing board according to claim 16, wherein the gypsum-based load-bearing board has a board thickness of less than 12 mm, a specific gravity of 0.96 or less, or both.

21. The gypsum-based load-bearing board according to claim 16, wherein the gypsum-based load-bearing board has a laminated structure in which a surface or a surface layer of the core material is covered with the paper.

22. The gypsum-based load-bearing board according to claim 16, wherein the main material or the core material of the gypsum-based load-bearing board contains an organopolysiloxane compound as a load-bearing strength deterioration inhibitor to prevent deterioration in load-bearing strength.

23. The gypsum-based load-bearing board according to claim 16, wherein the gypsum-based load-bearing board has the lateral nail resistance of 980 N or less.

* * * * *